US005497642A

United States Patent [19]

Greis

[11] Patent Number: 5,497,642

[45] Date of Patent: *Mar. 12, 1996

[54] APPARATUS AND METHOD FOR FORMING PRECISION SURFACES ON SHAFT-LIKE COMPONENTS

[75] Inventor: Howard A. Greis, Holden, Mass.

[73] Assignee: Kinefac Corporation, Worcester, Mass.

[ * ] Notice: The term of this patent shall not extend beyond the expiration date of Pat. No. 5,379,620.

[21] Appl. No.: 370,582

[22] Filed: Jan. 9, 1995

Related U.S. Application Data

[63] Continuation of Ser. No. 82,061, Jun. 23, 1993, Pat. No. 5,379,620.

[51] Int. Cl.[6] ..... B21H 1/00

[52] U.S. Cl. ..... 72/19.8

[58] Field of Search ..... 72/19, 102, 104, 72/108, 110, 111

[56] References Cited

U.S. PATENT DOCUMENTS

| | | | |
|---|---|---|---|
| 1,118,732 | 11/1914 | Breedlove | 470/84 |
| 3,599,463 | 8/1971 | Sennstrom et al. | 72/108 |
| 3,605,468 | 9/1971 | Okray | 72/102 |
| 4,045,988 | 9/1977 | Anderson | 72/102 |
| 4,322,961 | 4/1982 | Greis | 72/108 |
| 5,379,620 | 1/1995 | Greis | 72/19 |

FOREIGN PATENT DOCUMENTS

| | | | |
|---|---|---|---|
| 3127392 | 4/1982 | Germany | 72/108 |

*Primary Examiner*—Lowell A. Larson
*Attorney, Agent, or Firm*—Wolf, Greenfield & Sacks

[57] ABSTRACT

An apparatus and method for forming precision surface shapes on shaft-like parts comprises a pair of substantially cylindrical and rotatable dies having forming surfaces located adjacent a shaft-like part therebetween. The shaft-like part is located in a size control ring according to this invention and is concentric with an axis of rotation of the size control ring. Each of the dies includes a size control surface that pressurably engages the size control ring. The size control ring is sized so that the forming surfaces are located at a predetermined forming depth in the shaft-like part when a predetermined level of preload force is applied between the size control surfaces and the size control ring. It is contemplated that the size control ring experiences elastic deflection upon application of the predetermined preload. A size adjustment mechanism is provided to vary the preload applied by the dies on the size control ring and the part. This adjustment mechanism can include a nut and screw or, alternatively, a hydraulic press. Similarly, a single pair of opposing forming surfaces can be provided or a plurality of axially displaced forming surfaces can be provided.

32 Claims, 17 Drawing Sheets

APPARATUS AND METHOD FOR FORMING PRECISION SURFACES ON SHAFT-LIKE COMPONENTS

This application is a continuation of application Ser. No. 08/082,061 filed on Jun. 23, 1993, now U.S. Pat. No. 5,379,620 granted Jan. 10, 1995.

FIELD OF THE INVENTION

This invention relates to an apparatus and method for precisely maintaining two moving cylindrical die surfaces with respect to one another to more precisely preform and size a cylindrical shaft-like part.

BACKGROUND OF THE INVENTION

In the production of various components such as those used in automobiles, home appliances, power tools, hardware and other high volume mechanical, electro-mechanical and electrical products, it is often desirable to create high precision smooth shaft surfaces. Such surfaces are typically utilized in conjunction with press fit bearings, sleeve bearing journals, controlled slide fitments, rotating element mountings, structural press fitments and other precise connections of mechanical elements to shaft-like parts.

Where such press fits and other precise connections are currently made into the interfaces of ball bearings, or other hardened elements, the surface of the shaft to be fitted is generally turned or drawn to a pregrind diameter, and then final sized by grinding the shaft on center or, alternatively, by centerless grinding. Typical grinding machinery is large and expensive for either process. Additionally, this grinding process is relatively slow and the grinding wheels require regular dressing to maintain their size and surface shape. The grinding process also creates chips and swarf that must be disposed of under controlled conditions, thus adding to shaft production expense and slowing production time. When a highly polished finish for the shaft surface is also required, such as in a high speed journal bearing application, subsequent polishing or other finish grinding is also necessary which also adds to process costs and time.

Less precise press fits of shafts into gears, laminations, commutators and similar rotating elements usually entail the use of straight or diamond pattern knurls. Knurled surfaces are generally created by cylindrical die rolling utilizing a rolling attachment in a turning machine or in a cylindrical die rolling machine that is employed subsequent to a lathe turning operation. Typically, the tolerance of the outside diameter of the knurl is less precise than the previously turned surface. However, since the surface is deformable and is generally concentric, it is acceptable for lower precision applications. Some more precise applications utilize a special straight knurl which, when rolled on the outside diameter of the shaft, more precisely follows the initial diameter of the shaft and when rolled on high precision surfaces can produce tolerances and concentricities which more closely approximate the original shaft surface dimension. In these high precision knurling operations, the rolling is frequently performed on a surface that has been previously ground. For additional precision, some knurled surfaces are actually ground subsequent to rolling. These surfaces are suitable for press fitting into hardened bores or other similar not easily-deformed elements.

To reduce shaft processing costs, and to eliminate the generation of chips and swarf, various cold work processes have been employed involving the swaging of the journal and press fit areas on shafts to the required precision. However, precision and size repeatability have not proven accurately controllable to desired high tolerances with such swaging processes.

Similarly, direct roll sizing of the shaft using a cylindrical die rolling machine has been attempted for shafts of cold finished steel having an original diameter tolerance range of 0.002 inch (50 microns). However, even the stiffest rolling machines and the highest grade dies have exhibited spring-back characteristics and run out, respectively, that limit diametral repeatability and adjustability of the rolled surfaces. Hence, the tolerance obtained from a conventional cylindrical die rolling process is limited.

It is therefore an object of this invention to provide an improved method and apparatus for forming high production shaft-like parts with precision surfaces. The method and apparatus should entail little or no generation of chips or swarf and should enable formation of surfaces having increased tolerances for high precision applications. Such tolerances should preferably be within the range of approximately 0.0003 inch (8 microns). This tolerance range should be highly repeatable and size adjustability should be contemplated according to this method and apparatus.

SUMMARY OF THE INVENTION

This invention relates to the production of low-precision preform surfaces on shaft-like parts which can be subsequently reformed to the desired finished diameter. Tolerances according to this invention are contemplated as falling within a range of approximately 0.0003 inch. This invention provides, in a preferred embodiment, a rotatable size control ring into which a shaft-like part is concentrically mounted. A pair of cylindrical rotating dies are provided upon either side of the size control rings. The dies have forming surfaces that include preform surfaces over at least a portion of their circumference that engage the shaft-like part. The dies also include size control surfaces that are substantially concentric with the dies' forming surfaces and that engage and rotate the size control ring. The dies are mounted on bases that are biased pressurably toward each other by means of a size adjustment screw and nut according to a preferred embodiment. By applying a preload of, typically, in a range of 25,000–50,000 pounds, an elastic deflection occurs between the size control ring and the size control surfaces. The elastic deflection substantially reduces the effects of bearing play in the dies and also of spring-back in the shaft-like part and die forming surfaces. Accordingly, an accurate and repeatable surface is formed on the shaft-like part.

Each of the dies' forming surfaces can include a reform surface thereon substantially adjacent to the preform surface and preforming and reforming of the shaft-like part can be accomplished in one revolution of the dies. Alternatively, after preforming by rolling or cutting (turning or grinding, for example) reforming can be accomplished using a fully enveloping cylindrical sizing die that can be placed over an end of the shaft-like part to obtain a final shape from the preformed part surface.

Each of the dies, according to an alternate embodiment, can include a pair of forming surfaces spaced axially from each other. The size control surface of each die can be located therebetween for engaging a rotatable size control ring. The part is exposed at either end of the size control ring to a respective die forming surface. The pair of forming surfaces can be used to simultaneously form axially remote preformed and reformed surfaces on the shaft-like part.

BRIEF DESCRIPTION OF THE DRAWINGS

The foregoing and other objects and advantages of the invention will become more clear with reference to the following detailed description as illustrated by the drawings, in which.

DETAILED DESCRIPTION OF PREFERRED EMBODIMENTS

Figure 1:
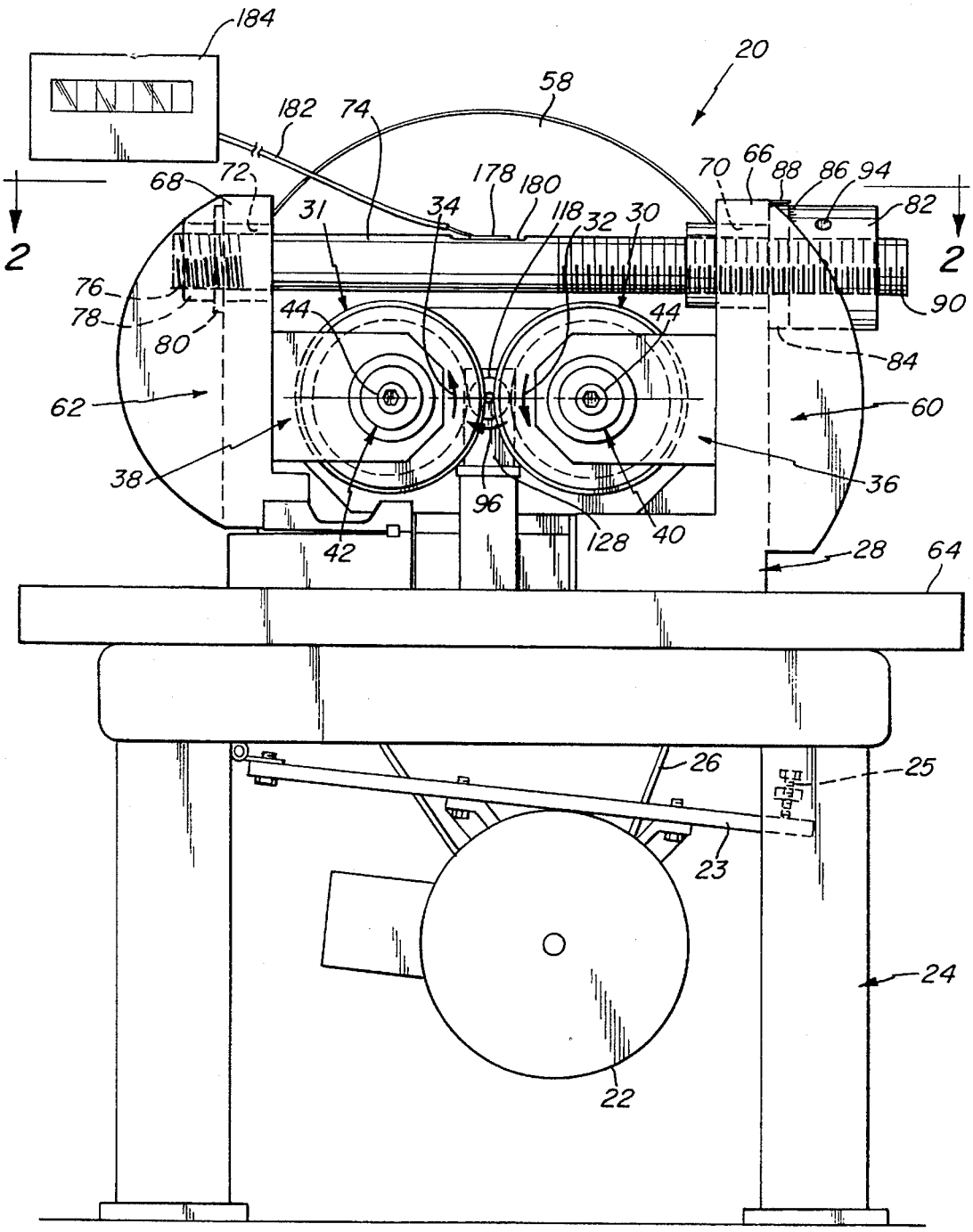
FIG. 1 is a front elevation view of a preferred embodiment of an apparatus for forming precision surfaces on shaft-like parts according to this invention.

A cylindrical die rolling machine 20 according to a preferred embodiment of this invention is illustrated in FIG. 1. The machine 20 according to this invention is powered by a motor 22 located in the base 24 of the machine. The motor 22 is connected by a belt 26 to the upper operative portion 28 of the machine 20. The tension of the belt 26 is adjustable by varying the location of the hinged motor mounting bar 23 using the set screw 25. The upper portion 28 of machine 20 is further detailed in FIG. 2. The machine 20 according to this embodiment is constructed to hold a pair of cylindrical dies 30 and 31 that are driven by the motor 22 to rotate in the same direction (clockwise arrows 32 and 34). The dies 30 and 31 are held in place by a pair of opposing brackets 36 and 38 by means of keyed shafts 40 and 42, respectively. The dies 30 and 31 are axially retained on the shafts 40 and 42 by means of hex head screws 44 according to this embodiment. The dies 30 and 31 are particularly mounted on two parallel axis spindles at the ends of shafts 40 and 42 similar to those described in Applicant's U.S. Pat. No. 4,322,961 which is expressly incorporated herein by reference. The shafts 40 and 42 are interconnected with a gear box 46 according to this embodiment. The gear box 46 is further detailed in FIG. 3. Each of shafts 40 and 42 is keyed to a respective drive gear 50 and 52 that, in this embodiment, are positioned in an oil-filled sump 54. The gears 50 and 52 intermesh with a central drive gear 56 that is interconnected to an enlarged pulley 58 according to this embodiment. The pulley 58 is interconnected by the belt 26 to the motor 22 and rotated thereby. The gears 50, 52 and 56 of gear box 46 should be tightly fitted and of high precision to provide minimal backlash to the shafts 40 and 42. As such, dies 30 and 31 are driven smoothly in phased angular relation with one another, and with minimal rotational play. To this end, each die 30 and 31 is mounted on a shaft end having a large (6–7 inch) high precision anti-friction bearing according to this embodiment.

Each of the die brackets 36 and 38 are mounted on respective arms 60 and 62. In this embodiment, arm 60 is bolted securely to the machine's supporting base plate 64 while opposing arm 62 can pivot within a limited range of movement relative to the base plate 64.

Arms 60 and 62 include vertical extensions 66 and 68 having holes 70 and 72 located therethrough. Through each of the holes 70 and 72 passes an enlarged size adjustment draw bar or screw 74 according to this embodiment. The size adjustment draw bar 74 according to this embodiment typically comprises a hardened threaded shaft having an outside diameter of between 2–3 inches. In this embodiment, the end of the bar 74 adjacent arm 62 includes a short threaded section 76 having attached thereto an enlarged nut and washer 78 and 80, respectively. The nut 78 and washer 80 are typically locked in place using a high strength thread locking compound or, alternatively, a collar or similar block can be provided to the end of the bar 74. The nut 78 and washer 80 are sized in diameter to bear against the walls of the extension 68, thus preventing the draw bar 74 from exiting the hole 72 upon application of tension to the bar 74.

The opposing extension 66 includes hole 70 through which the opposing end of the size adjustment draw bar passes. According to this embodiment, the bar 74 is radially clear of the hole 70 along its length, but is held in place by a size adjustment nut 82 that bears against an outwardly facing side of the extension 66 according to this embodiment. The size adjustment nut 82 bears against a freely rotation spherical joint 84 according to this embodiment. The nut 82 includes micrometer graduations 86 located adjacent a fixed pointer 88 mounted on the extension 66 and directed toward the graduations 86. The nut 82 includes threads sized to engage the threads 90 on the adjustment draw bar 74. Accordingly, as the nut 82 is rotated, it draws the bar 74 toward the joint 84. In this manner, the extension 68 and arm 62 are pivoted toward the opposing arm 60 and, hence, the die 31 is drawn toward the die 30.

In this embodiment, a plurality of surface holes 94 are located on the size adjustment nut 82 so that a removable spanner wrench can be inserted into the holes 94 to facilitate rotation of the nut 82 for applying the desired preload by deflecting the entire system.

The dies 30 and 31 according to this embodiment are constructed so that their forming surfaces bear upon a portion of the surface of a shaft or a shaft-like part blank 96. The structure of the die forming surfaces will be described more fully below. In summary, the dies rotate through at least one revolution to provide a preform, and then a reform shape to the surface of the shaft at a predetermined point therealong according to one embodiment of this invention. The final formed surface contour of the shaft-like part can be utilized where a precision fit is required such as in mounting of a press fit bearing as shown, for example, in FIG. 11 in which shaft 100 includes bearing surfaces 102 and 104. The shaft 100 in this example is a typical motor armature that supports laminations 106 and is supported by bearing surfaces 102 and 104 in a press fit bearing 108 and a journal sleeve bearing 110, respectively. Shaft sections 107 and 109, which are used to mount the motor laminations and commutator 111, respectively, define less accurate straight knurled surfaces that can be provided to the shaft in another forming step. The illustrated embodiment of FIG. 1 particularly details the formation of the press fit bearing surface 102 according to this invention. However, the principles used herein can be utilized to form a variety of precision surfaces on shaft-like parts.

The dies 30 and 31 according to this embodiment include enlarged diameter forming surfaces 110 and 112, respectively. Rearward of the forming surfaces, each die 30 and 31 includes, integrally formed therewith, a substantially concentric size control surface 114 and 116, respectively. The size control surface is smaller in diameter than the respective forming surface. The size control surface is also substantially more axially elongate than the respective forming surface. In this embodiment, forming surfaces 110 and 112 are approximately 10 inches in diameter while size control surfaces are approximately 7 5/16 inches in diameter. The forming surfaces have an axial width of approximately 3/8–3/4 inch and the size control surfaces have an axial width of approximately 2–3 inches according to this embodiment. However, widths and diameters can vary widely depending upon the forming applications.

Figure 4:
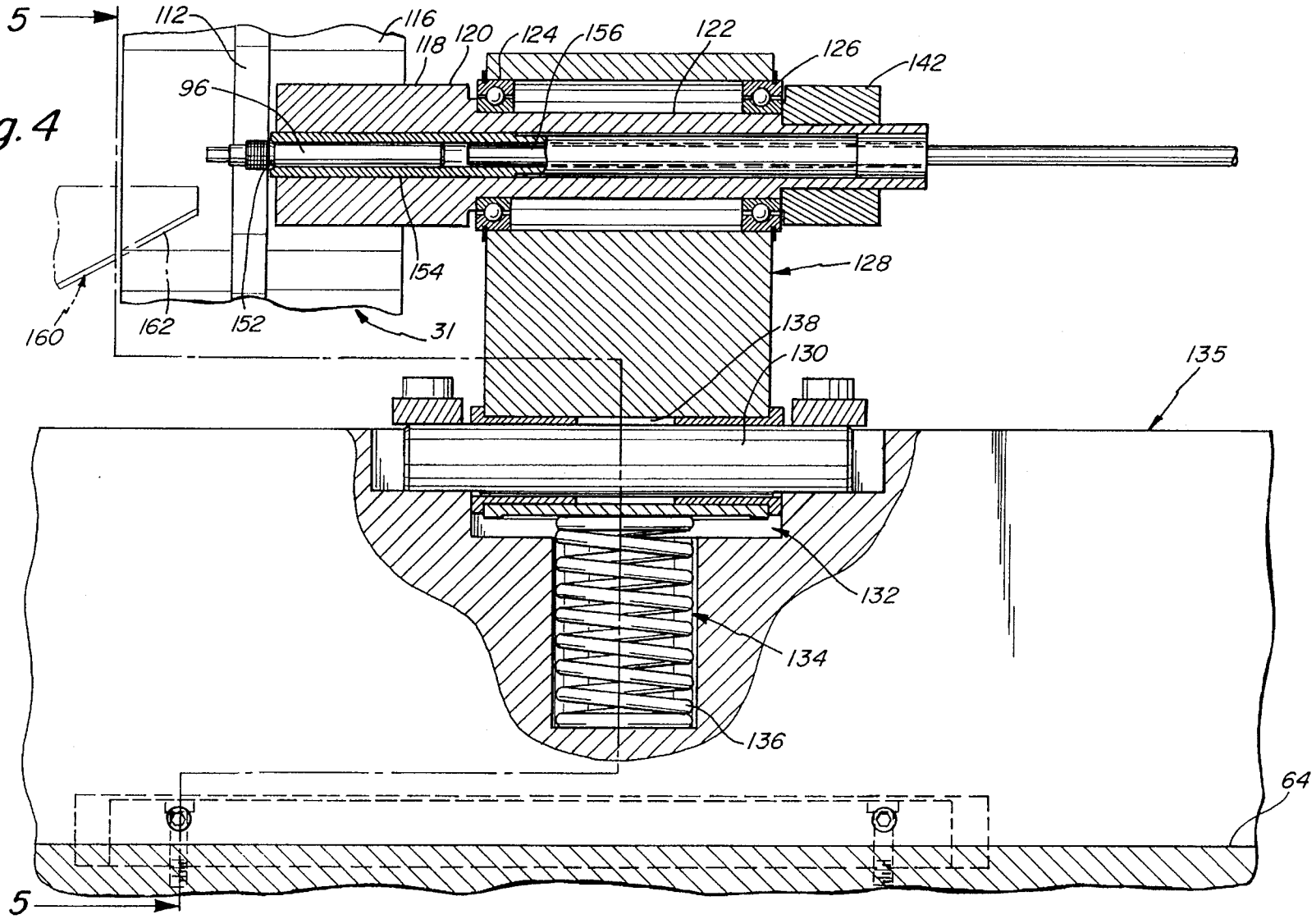
FIG. 4 is a partial side cross-section of the apparatus taken along the line 4—4 of FIG. 2.
Figure 5:
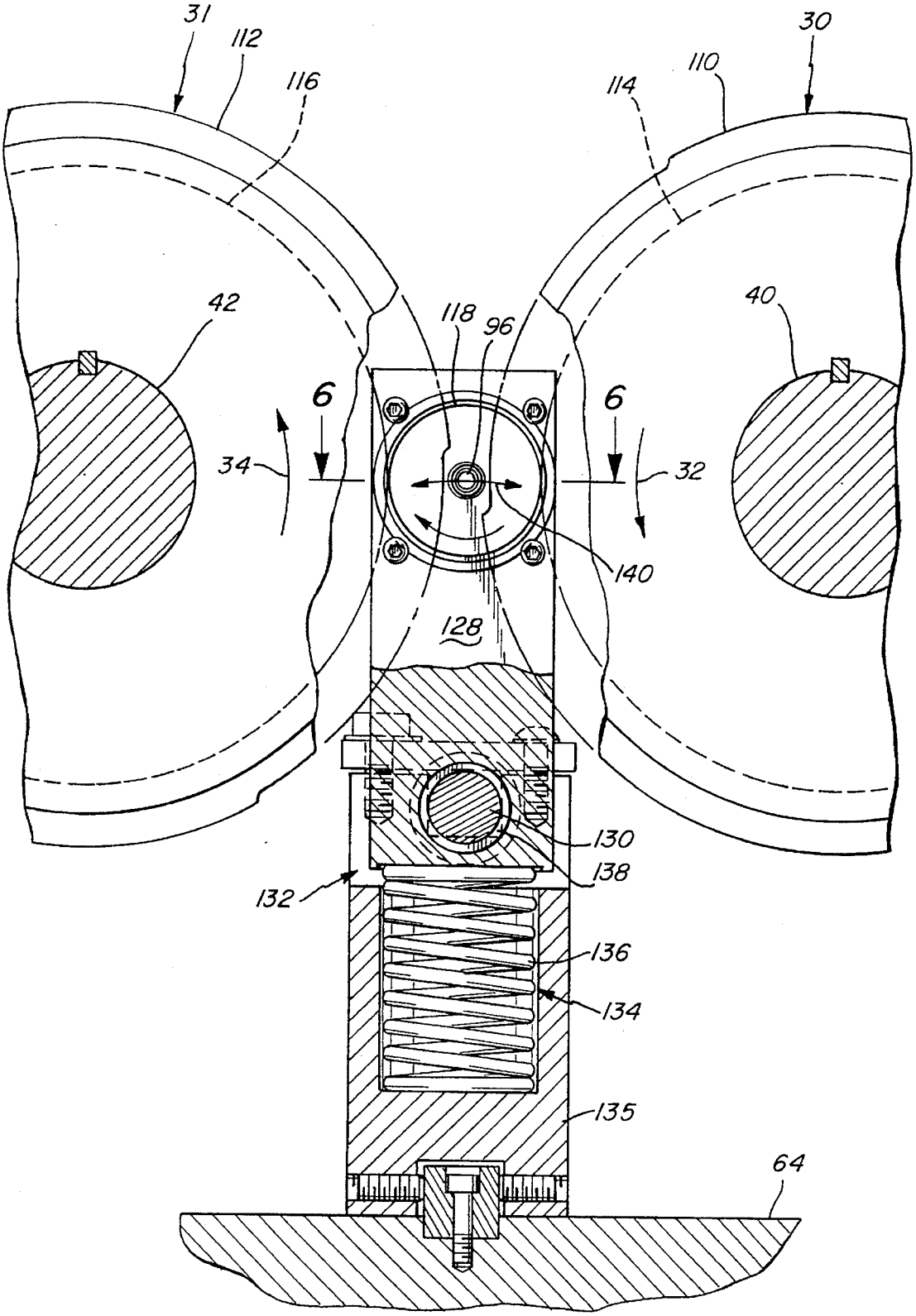
FIG. 5 is a partial cross-section of the apparatus detailing the die forming surfaces and size control ring according to this embodiment.
Figure 6:
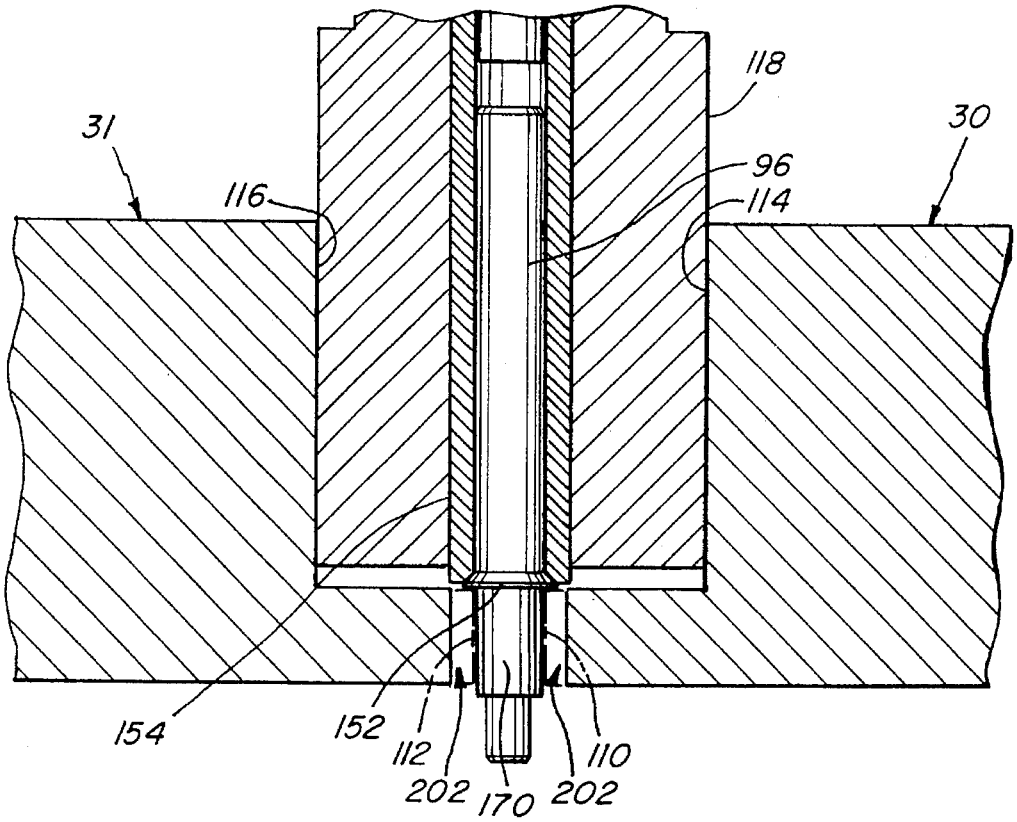
FIG. 6 is a partial cross-section taken along line 6—6 of FIG. 5.

The size control surfaces 114 and 116 according to this embodiment are provided to bear upon a centrally located and rotatable size control ring 118 that is detailed more clearly in FIGS. 4–6. A lubrication source (not shown) can be provided to deliver oil to the size control ring and surfaces and to other moving parts of the system. The size control ring 118 according to this embodiment comprises a precision ground cylindrical shaft constructed, preferably, of tungsten carbide or high speed tool steel having a hardness above C62 on the Rockwell scale. The characteristics of the size control ring shall be described further below. However, for purposes of illustration, the ring 118 consists of a main section 120 with a highly polished precision ground surface that bears against the die size control surfaces 114 and 116. The main section 120 steps into a narrower shaft section 122 that is rotatably held by a pair of precision ball bearings 124 and 126 within a bracket 128. The bracket 128 is joined to a bracket base 130 that is supported within a mounting base 135 in a hollowed out section 132 on a spring suspension 134 that comprises a coil spring 136 according to this embodiment. The mounting base 135 is bolted to the machine base 64. Hence, the size control ring 118 can move with respect to mount 130 within a predetermined limited range of movement. As detailed in FIG. 5, the mount 130 comprises a rod and the bracket 128 includes a hole 138 having a diameter somewhat larger than the mount 130 outer diameter. Accordingly, the bracket 128 is constrained vertically, but is free to move a small distance horizontally which enables the ring 118 to accommodate small centering changes due to die regrinding, etc. The size control ring 118 is free to move radially, in response to contact with size control surfaces 114 and 116, as the die 31 moves against the die 30 in response to pressure applied by the size adjustment draw bar 74. Side-to-side movement of the size adjustment ring 118 is symbolized by the slightly curved arrow 140 in FIG. 5.

With further reference to FIG. 4, the shaft section 122 of the size adjustment ring 118 is held in bearings 124 and 126 against axial movement by means of a block 142.

The size adjustment ring 118 and rearwardly directed shaft section 122 are hollow along their center. In this embodiment, the shaft-like part includes a shoulder 152 having a larger outer diameter than the more rearwardly directed portion of the shaft. A sleeve 154 (see FIG. 6) is provided to the inner diameter of the ring 118 at its main section 120. The sleeve 154 has an inner diameter substantially equal to the outer diameter of the shaft-like part 96 with an approximate clearance therebetween of 0.002 inch. The sleeve 154 allows the part to be held on the line of the die centers (rotational axes), but free to rotate at a different velocity than that of the size control ring 118.

Rearward of the size control ring, along the size control ring shaft 122, is located an ejector rod 156 according to this embodiment. The ejector rod 156 moves axially to eject completed shaft-like parts from the size control ring upon completion of the die rolling process. The ejector rod 156 also serves to regulate the axial position of the shaft-like part relative to the dies 30 and 31 according to this embodiment. Shaft-like parts with flanges typically enter the size control ring 118 from the front and then are subsequently ejected out of the front. Alternatively, shaft-like parts without flanges can be loaded from the front and ejected down the bore of the size control ring to the rear. Upon ejection from the front according to this embodiment, shaft-like parts pass onto a chute 160 having a funnel-like opening 162 adjacent the size control ring 118. The shaft-like parts pass from the funnel-like opening 162 into a transport tube 164 (FIG. 2) that is typically downwardly directed toward a completed parts bin where other conveying systems direct the shafts to downstream locations for further processing (not shown).

The size control ring 118 is positioned between each of the size control surfaces 114 and 116 of dies 30 and 31, respectively. As the size control nut 82 is tightened on the draw bar 74, it causes die 31 to be biased toward die 30. Accordingly, the die forming surfaces 110 and 112 are placed into a position to pressurably engage a predetermined portion of the shaft-like part 96 located in the size control ring 118 therebetween. By pressurable engagement, it is meant an application of force suitable to cause a surface shape by the die forming surface on the part surface. The die forming surfaces 110 and 112 particularly engage a presized surface 170 (FIG. 6) on the unformed (blank) shaft-like part 96. The surface 170 has an outer diameter that is relatively closely sized. It can be formed by means of extruding, grinding or turning, or by other suitable forming operations prior to entry into the machine 20 of this invention. In order to obtain a desired finished tolerance of approximately 0.0003 inch in this application of the preferred embodiment, a blank surface (170) tolerance in a range of approximately 0.003 inch should be maintained.

The die forming surfaces 110 and 112 pressurably engage the part surface 170 and form a desired shape thereinto. According to this embodiment, the engagement of the die surfaces 110 and 112 with the part surface 170 causes the part surface to rotate as shown by the arrow 172 in FIG. 7. Moreover, the main section 120 of the size control ring 118, according to this embodiment, is specifically sized to engage the size control surfaces 114 and 116 of the dies 30 and 31 in order to firmly maintain the shaft-like part 96 in registration with the die surfaces 110 and 112. To this end, the size control ring 118 should be accurately ground to a predetermined diameter.

According to this invention, the pressure applied by the size adjustment draw bar 74 on the dies 30 and 31 causes the size control surfaces 114 and 116 to bear against and elastically deflect the main section 120 of the size control ring 118. By providing dies and a size control ring from very stiff material such as tungsten carbide or high speed tool steel, having a hardness of at least Rockwell C62, a great deal of pressure can be applied by the die size control surfaces 114 and 116 to the size control ring 118 before any permanent or "plastic" deformation of the ring 118 or size control surfaces 114 and 116 occurs. Rather, the die size control surfaces 114 and 116 provide an elastic deflection to the size control ring 118. Hence, an elastic "flat" is formed at their contact surfaces. This flat serves several purposes. Firstly, the flat firmly maintains the size control ring 118 relative to the dies 30 and 31 resulting in a very accurate registration of the part surface 170 relative to the die forming surfaces 110 and 112. Secondly, the elastic deflection insures that tremendous pressure is generated in the bearing surfaces of each of the die spindles or shafts to eliminate any play in the draw bar, arms, bearings and other members of the system. Accordingly, the dies and their drive members and shafts (40, 42) are fully preloaded as the die surfaces 110 and 112 bear against the part surface 170. As such, non-elastic play in the system is essentially eliminated. In a preferred embodiment, a preloading of approximately 25,000–50,000 pounds is generated before the appropriate die forming depth into the part is obtained. In other words, the size control ring diameter is chosen so that the selected initial 25,000–50,000 pounds brings the dies to a minimal desired forming depth on the surface. It should be noted that the desired preload varies based upon the hardness and Young's Modulus of the materials used for the dies and size control ring and their respective diameters. In this embodiment, each additional 1,000 pounds applied to the system causes approximately a $1/10{,}000$ inch change in the final finished diameter of the part surface.

Figure 2:
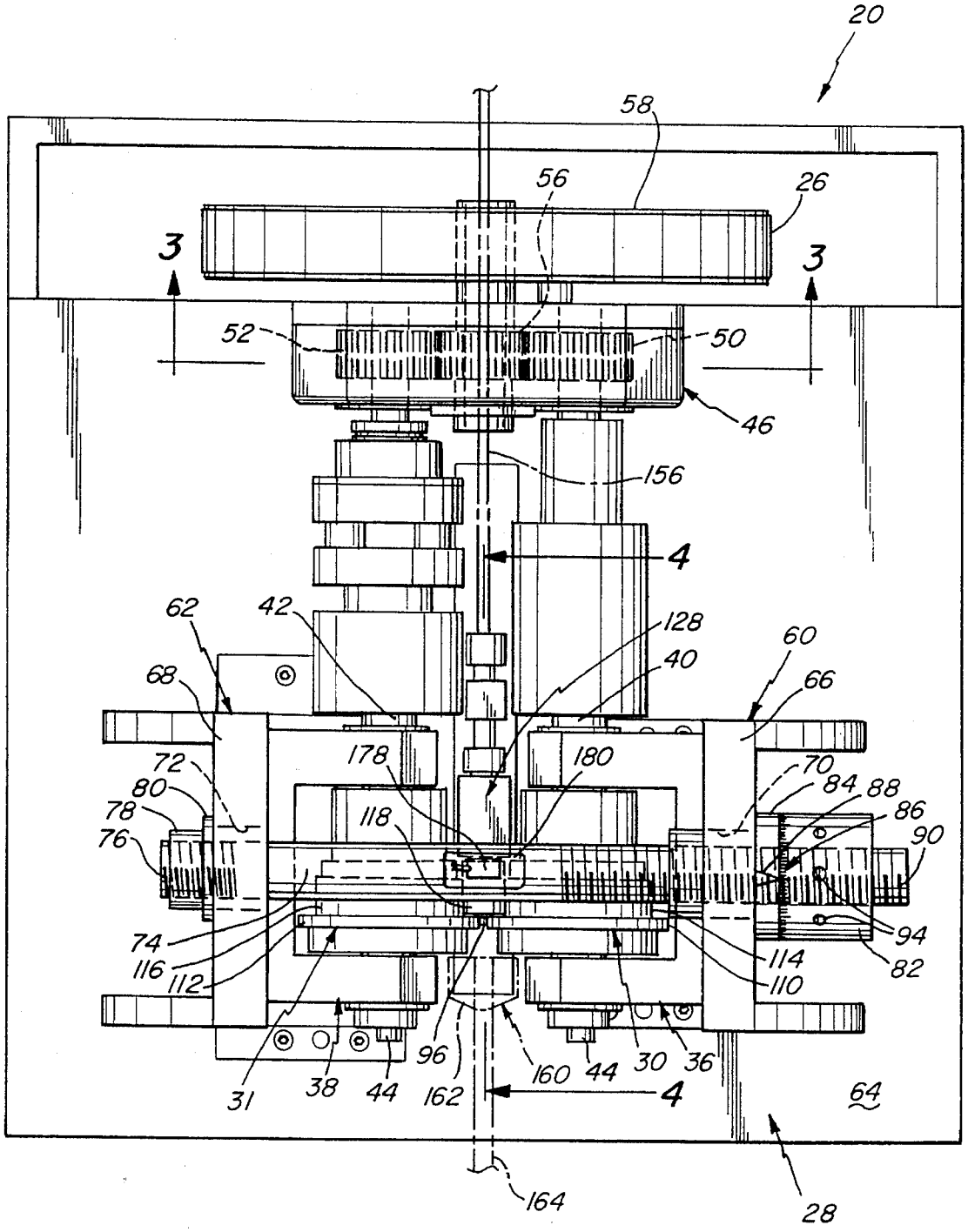
FIG. 2 is a top plan view of the apparatus taken along line 2—2 of FIG. 1.
Figure 3:
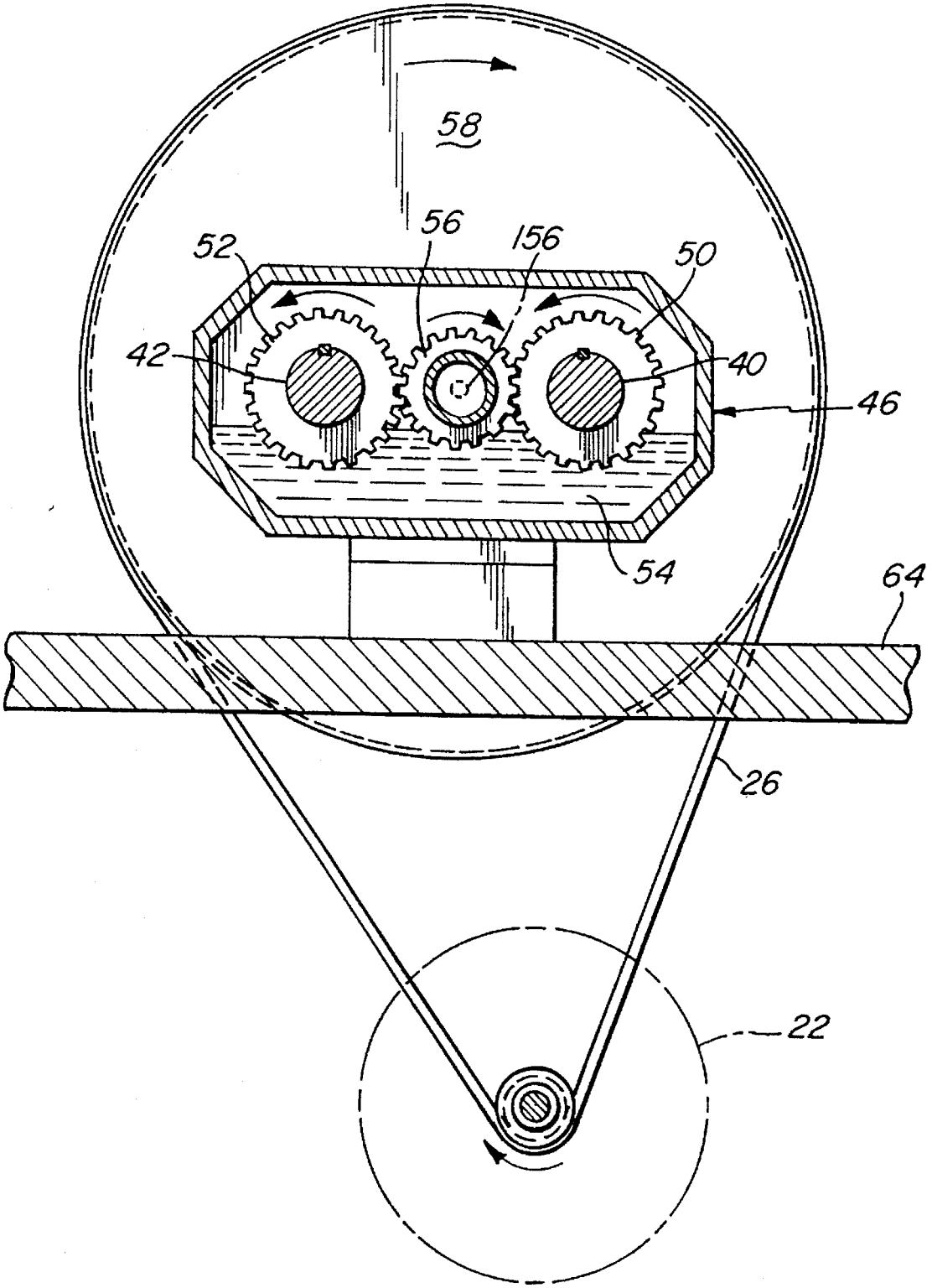
FIG. 3 is a somewhat schematic cross-section of the drive gear train of the apparatus of FIG. 1 taken along line 3—3 of FIG. 2.

As depicted in FIGS. 1 and 2, the size adjustment screw 74 according to this embodiment includes a strain gauge 178 cemented to the size adjustment screw 74 surface. A flat 180 can be provided for accurately seating the gauge 178. The gauge 178 is interconnected by wires 182 to a readout 184 that can be graduated in pounds or another suitable measurement of force according to this embodiment. Appropriate transducers in the readout (not shown) are provided to translate strain gauge data into force data in desired units. Force data can be correlated into forming depth data so that a desired forming depth can be maintained on the part according to this invention.

Thirdly, the massive preload applied through the system forces the size control surfaces 114 and 116 of the dies into contact with the surface of the size control ring 118 to produce an elastic deformation of the contacting surfaces (a flat). The preload exceeds the required reforming load by more than ten times. In addition, the variation between the reforming load needed to reform the largest preform diameter and that required to reform the smallest preform diameter is generally less than one third of the maximum reforming load. As a result, the ratio of variation in reforming load to preload is very small, generally below one to thirty (1:30). Therefore, the relative positions of the two die reforming surfaces vary by approximately the same ratio as the original preload deformation. This results in changes in the positions of the dies, due to changes in the load during the reforming process which are generally less than five percent of the desired tolerance range of the final reformed part surface. Accordingly, the reforming process is substantially independent of initial preform outside diameter variations within the typical preform tolerance ranges of the illustrated embodiments.

Since the amount of material reformed by the dies during the sizing operation is small, virtually no heat is generated and since the deformation depth is so small that it is independent of forming rate, the process can be carried out at high speeds without loss of repeatability. As a result, in the preferred embodiment which uses an automatic part feed unit, production rates of 20 to 40 units per minute can be achieved. Where parts are loaded from the front and unloaded from the rear, production rates at least as high as 60 units per minute can be achieved.

Figure 6A:
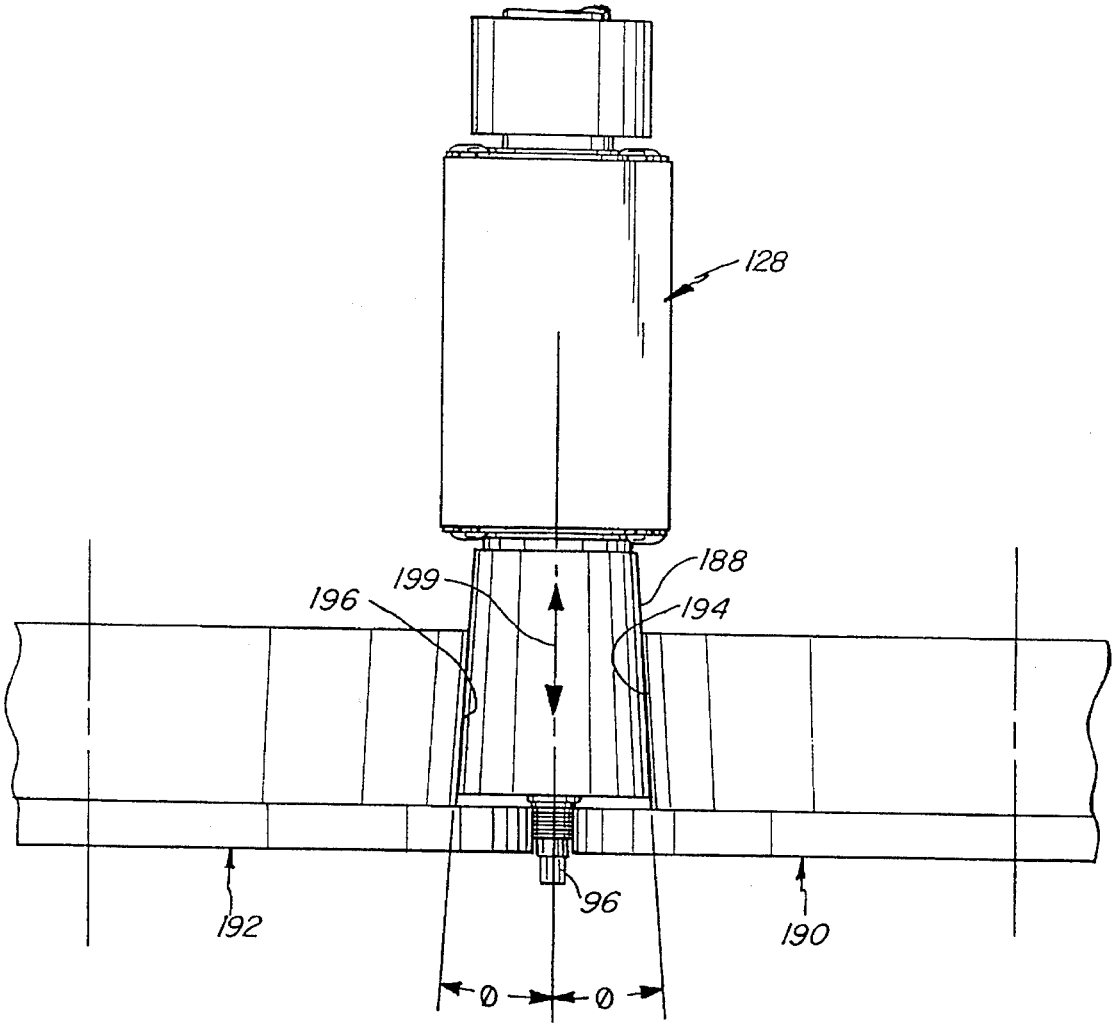
FIG. 6A is an alternate embodiment of a size control ring and die size control surfaces having a taper to regulate size control.

FIG. 6A illustrates an alternative embodiment in which the size control ring 188 includes a conical or tapered shape. The cone according to this embodiment tapers in a frontward to rearward direction. Each of the dies 190 and 192 includes a corresponding size control surface 194 and 196, respectively. The size control surfaces 194 and 196 are each tapered to conform to the tapered contour of the size control ring 188. The conical size control ring 188 (having a taper of $\theta$, which in this embodiment is between 1° and 5°) provides a method of rough size control by moving the tapered size control ring 188 axially (double arrow 199) relative to the size control surfaces 194 and 196. This rough size adjustability enables the dies to be brought into a desired initial position without the need to regrind the size control ring.

Figure 7:
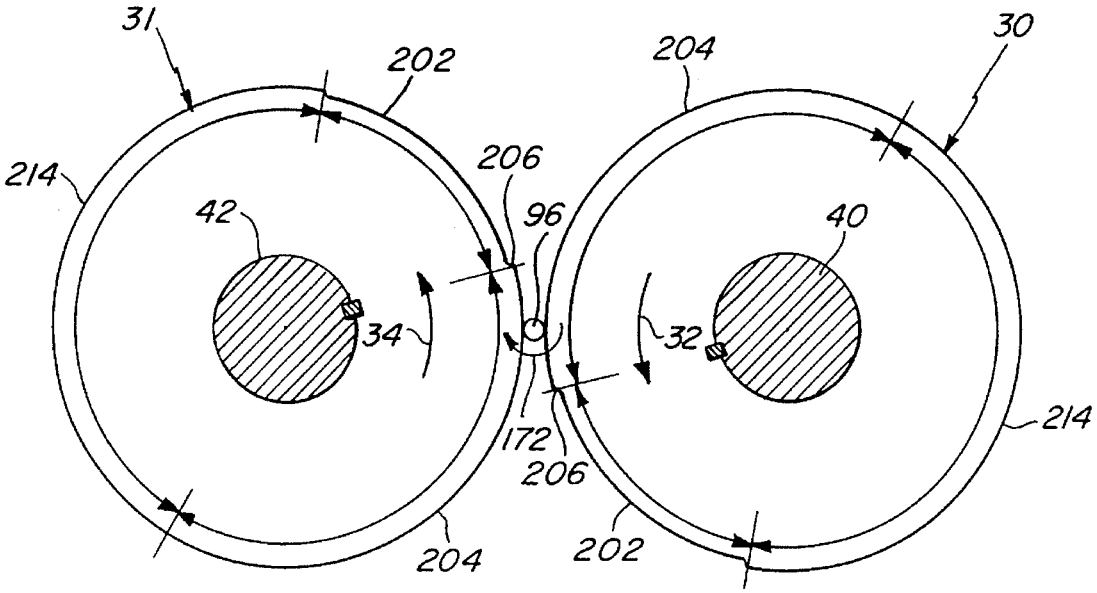
FIG. 7 is a somewhat schematic view of the die forming sections according to this invention.

With further reference to FIG. 7, each of the dies 30 and 31 according to this embodiment includes a plurality of forming sections. In summary, each die includes a cutout section 202 that spans approximately 60° of the circumference. The cutout section 202 is radially relieved by approximately $1/16$ inch according to this embodiment. However, the depth of the cutout 202 should be sufficient so that any shoulder on the shaft-like part, such as shoulder 152 (FIG. 6), is clear of the die surfaces when both cutouts 202 are positioned adjacent the part. Hence, the part can be freely passed into and out of the size control ring passed the cutouts 202.

Adjacent the cutout sections 202 are positioned the preform sections 204 according to this embodiment. Once a part is positioned in proper registration relative to the die surfaces 110 and 112, the dies begin to rotate as shown by the arrows 32 and 34 until the preform sections 204 come into contact with the part surface 170. The preform sections 204, as is described further below, define a variable radius relative to the axis of rotation of the die. The initiation 206 of the preform sections 204 defines a radius from an axis of rotation of each die that is substantially equal to the distance from the axis of rotation to the presized (blank) part surface 170. Hence, at the initiation point 206 of each die preform surface 204, no substantial forming pressure is placed upon the part surface 170. The preform surface radius, however, increases along the circumference of the die so that increasing forming pressure is placed upon the part surface 170 until, at a predetermined point along the preform surface circumference, full forming depth is attained.

Figure 8:
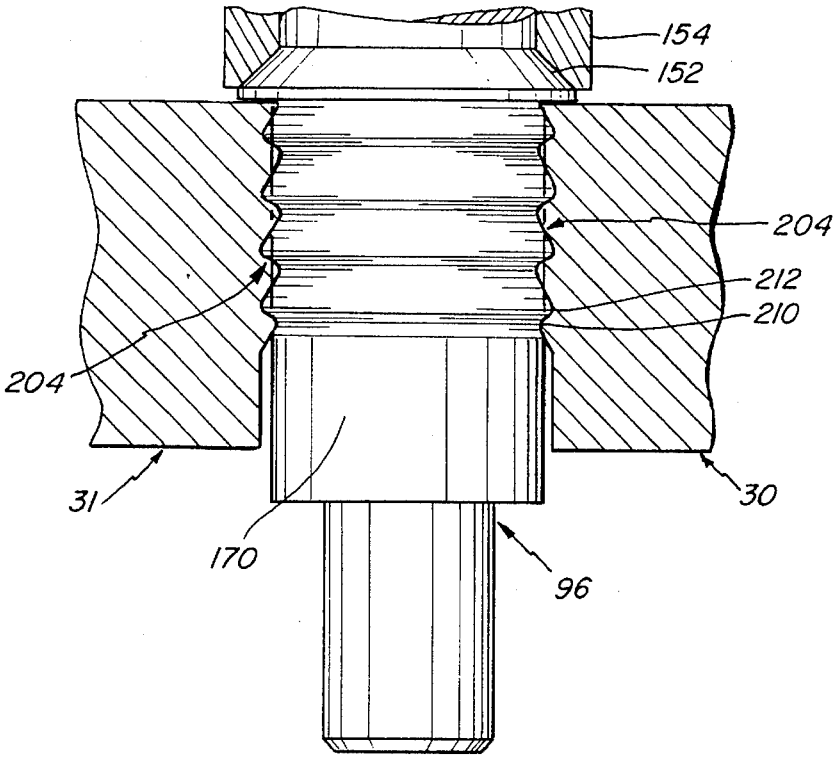
FIG. 8 is a partial plan view of a typical preforming process for a press fit bearing surface according to this invention.

FIG. 8 is an enlarged view of a preforming operation on the part surface 170. In the depicted embodiment in which a press fit bearing surface is being formed, the preform die surface 204 (which spans a circumference of approximately 120° in this embodiment) generates relatively deep troughs 210 and crests 212 on the part surface 170. These troughs and crests 210 and 212 relocate the material along a portion of the part surface 170 in preparation for the sizing process. The crests 212 define a larger radius on the shaft-like part surface 170, than the desired final surface. These crests 212 are sized downwardly in radius by the reform process.

Figure 9A:
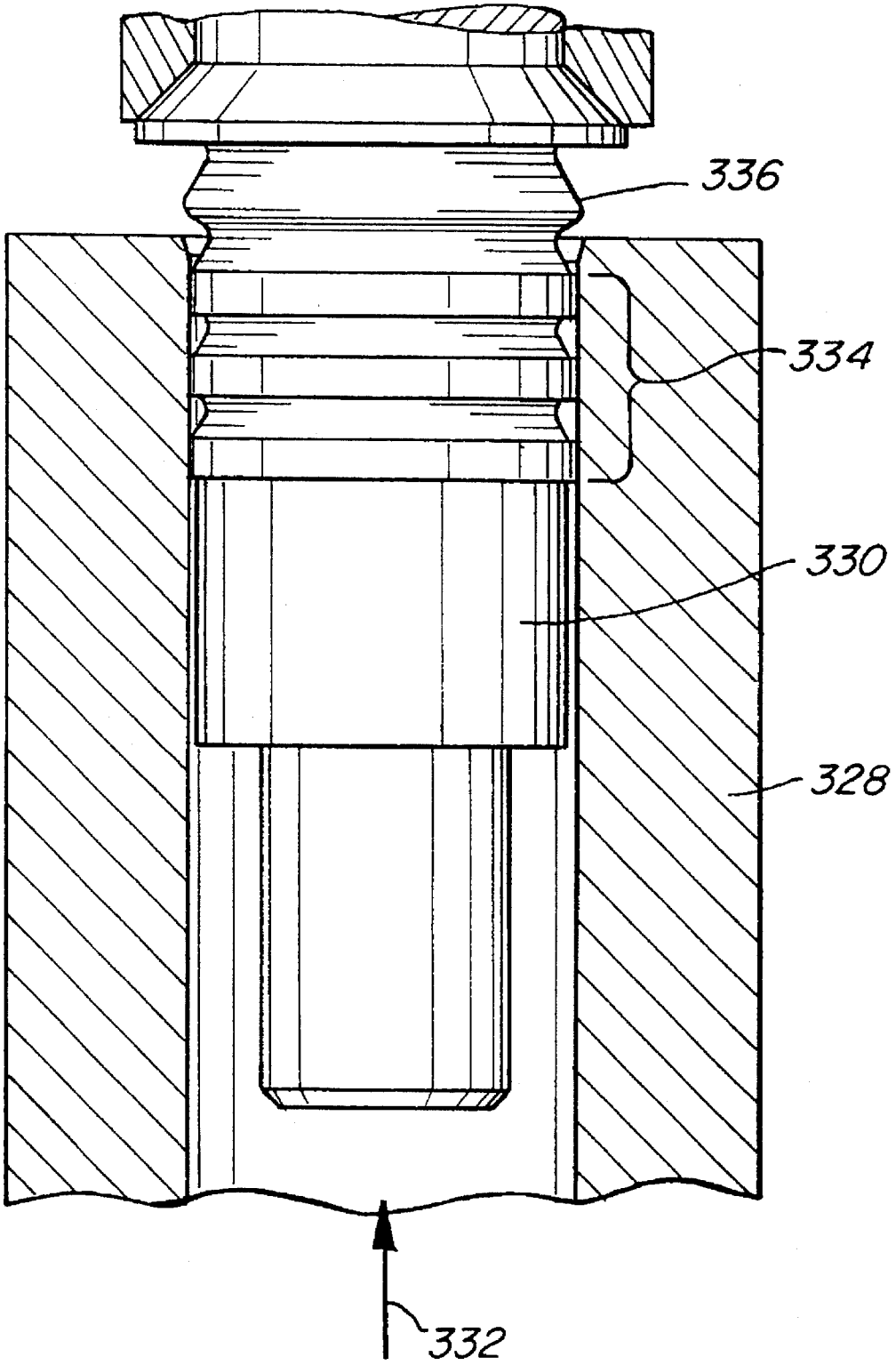
FIG. 9A is an alternate embodiment of a reforming process for a press fit bearing shaft surface according to FIG. 8 utilizing a fully enveloping cylindrical sizing die for reforming.
Figure 9:
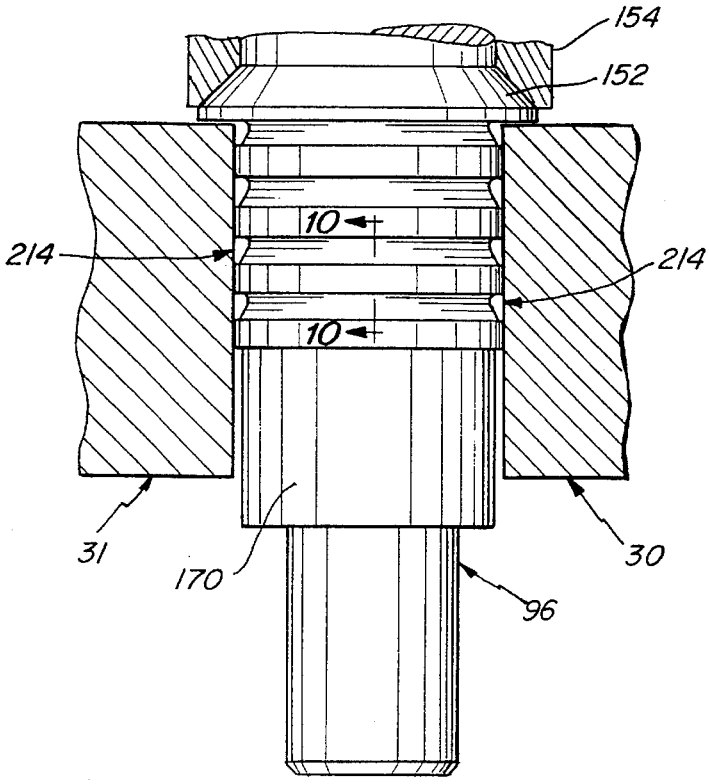
FIG. 9 is a plan view of a typical reforming process for a press fit bearing shaft surface according to FIG. 8.

In this embodiment, each die 30 and 31 includes a reform surface 214 that spans an additional 120° of the circumference. Unlike the crested and troughed surface of the die preform section 204, the surface of the reform section 214 is smooth and cylindrical. A typical reform operation utilizing such a reform surface is depicted in FIG. 9. Like the preform surface 204, the reform surface 214 initiates at a radius that is roughly equal to the distance between the die axes of rotation and the peaks of the preformed crests 212 on the part 96. Hence, it applies minimal force to the part surface 170 at its initial contact point. The reform surface 214 increases in radius to, accordingly, flatten out the crests 212 formed on the part surface 170.

Since the circumference of the die forming surfaces 110 and 112 are substantially greater than that of the part 96, the part rotates through many revolutions for each revolution of the dies 30 and 31. Typically, one revolution of a die is sufficient to fully form a desired bearing surface on the part 96. In this embodiment, preform grooves having a depth of approximately $^{9}/_{1000}$ inch are desired. Thus, the preform surfaces 204 should include an initial forming surface having approximately $^{1}/_{1000}$ inch of forming depth per part revolution and $^{9}/_{1000}$ inch in nine revolutions. The pitch of the preform surfaces 204 should be sized accordingly with an increase in radius by $^{1}/_{1000}$ inch for each die forming surface arc length through which one part rotation occurs.

Figure 7A:
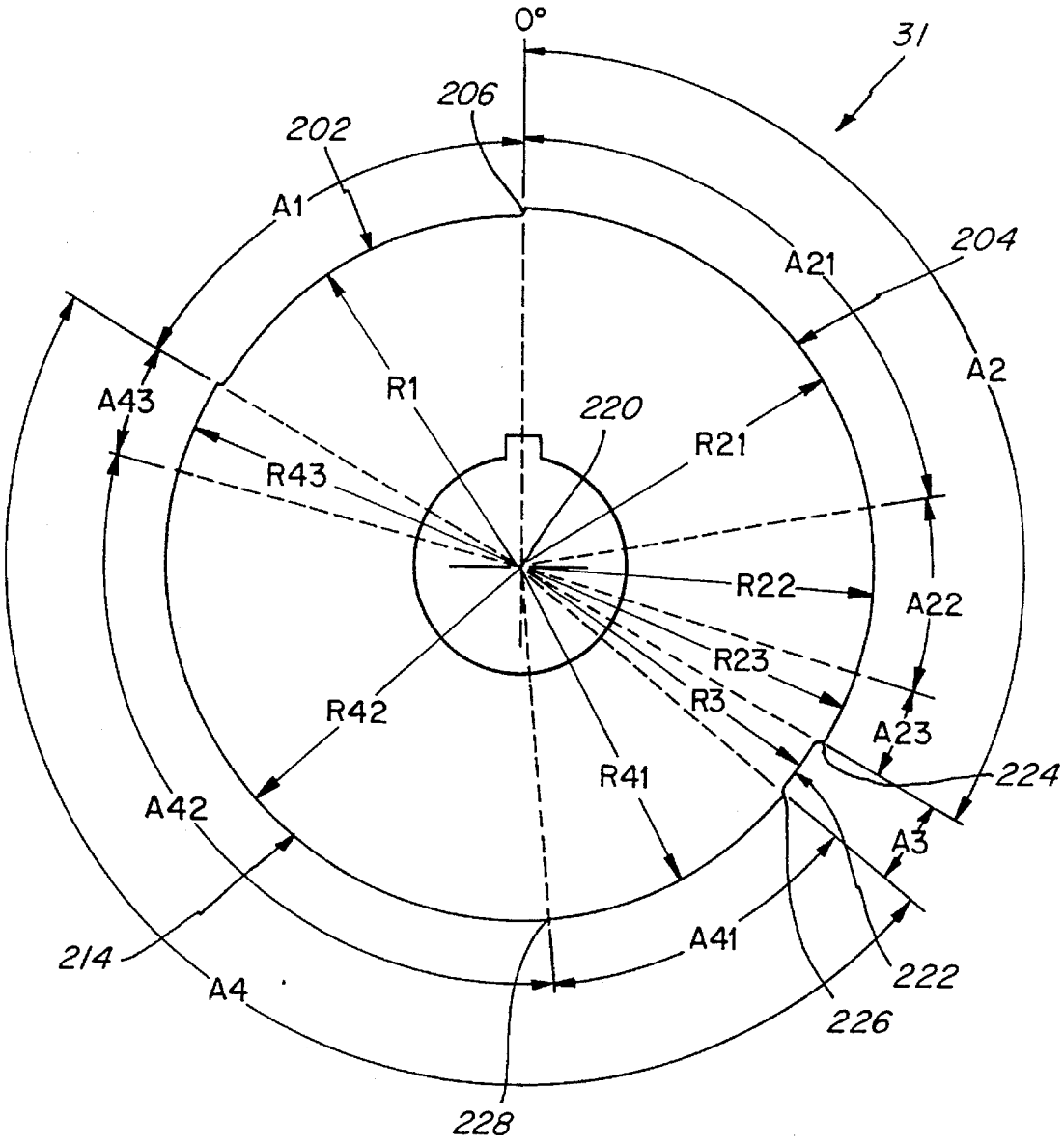
FIG. 7A is a more detailed schematic view of a die of FIG. 7 illustrating the circumferential locations of the various forming sections for a typical press fit bearing surface forming embodiment.
Figure 11:
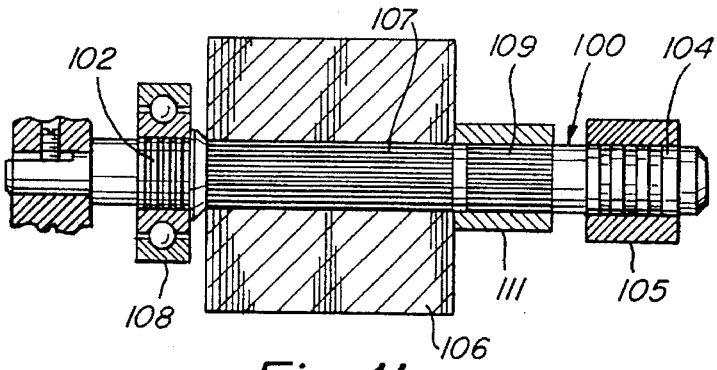
FIG. 11 is a somewhat schematic cross-section of a motor including a shaft-like armature having press fit and sleeve journal bearing surfaces formed according to this invention.

With further reference to FIG. 7A, a die 31 of the type utilized in forming the press fit bearing surface of FIGS. 8, 9 and 11 is illustrated. As noted above, the cutout 202 has a radius R1 from the die's axis of rotation 220 that is at least $^{1}/_{16}$ inch less than a radius required to contact the blank part surface 170 according to this embodiment. The arc A1 of the cutout 202 is approximately 60°. For the purposes of this description, the die forming sections shall be described in clockwise order. This order is reversed for die 30 which is located on the opposite side of the shaft-like part. From the initiation 206 of the preform section 204, the radius R2 increases. The entire preform section, as noted above, has an arc A2 of 120° according to this embodiment. Of this 120° arc, the first 80°, designated by arc A21, has a radius R21 that increases in a clockwise direction. As noted above, the pitch of the arc can be chosen so that approximately $^{1}/_{1000}$ inch of forming depth is added to the part surface 170 for each rotation of the part 96. Clockwise of the increasing radius section A21 is positioned a "dwell" section designated by arc A22. Arc A2 is, in this embodiment, 27°. It is characterized by a radius R22 that is highly concentric over the arc A22. This section serves to ensure that the desired depth is firmly pressed into the part with minimal spring-back. The part rotates through approximately three full rotations along this arc.

Clockwise of arc A22 is a decreasing radius section characterized by arc A23 that is typically 13° according to this embodiment. The radius R23 of arc A23 decreases rapidly by 8 to $^{9}/_{1000}$ inch over its relatively short distance. The purpose of this reducing radius arc is to gradually relieve pressure on the part surface 170 prior to initiation of the reform process. This prevents formation of undesirable flat spots on the part surface. Clockwise of arc A23 is located a second cutout 222 having an arc A3 according to this embodiment. Arc A3 is typically 10°. According to this embodiment, the radius R3 of arc A3 is $^{1}/_{16}$ inch less than the radius R23 at the end 224 of arc A23. Clockwise of the cutout 222 is located the initiation 226 of the die's reform section. As described above, the reform section according to this embodiment is a substantially flat cylindrical surface characterized by an increasing radius, followed by a "dwell" section having a constant radius and a decreasing radius. The reform section is defined by Arc A4 which is 170° according to this embodiment. The initiation of the reform section, characterized by arc A41, has an increasing radius R41 in a clockwise direction. Arc A41 is approximately 45° according to this embodiment. The radius R41 increases from an initial radius that corresponds to the crests 212 formed by the preform section on the part surface 170. The radius R41 increases by a few thousandths of an inch over its arc length. The end point 228 of arc A41 should have a radius R41 that equals the desired final radius of the bearing surface. Clockwise of arc A41 is located the reform dwell section characterized by arc A42 having a radius R42. Arc A42 is typically 110° according to this embodiment accounting for approximately 12 rotations of the part relative to the reform surface 114. The radius R42 is equal over arc A42. The part 96 is allowed to rotate through several rotations at a constant radius R42. This ensures that virtually all spring-back is removed from the material and that a final radius value within close tolerance (at least 0.0003 inch) is achieved. In order to attain a tolerance that is within ± $^{3}/_{10,000}$ inch, a concentricity of approximately $^{25}/_{1,000,000}$ inch should be obtained between the dwell area arc A42 and the die's axis of rotation 220. Similarly, the size control surface 114 or 116 of the respective die 30 or 31 should have a concentricity to within a few millionths of an inch (preferably under 10 millionths) in order to maintain the desired tolerance. The size control ring itself requires concentricity tolerance on a similar order of magnitude.

It should be noted that the depth to which the dies penetrate the surface 170 of the part 96 is determined in part by the diameter of the size control ring. A certain degree of elastic deflection occurs between the size control surfaces 114 and 116 of the dies 30 and 31 and the size control ring 118. The Size control ring is typically ground until a desired preload (typically 25,000–50,000 pounds in this embodiment) enables the die forming surfaces to penetrate to an appropriate depth. The exact penetration depth of the die forming surfaces can be adjusted within predetermined limits by means of the size adjustment nut 82. However, the size control ring should be initially ground until the depth is to within a few ten thousandths of an inch of the correct forming depth, thus allowing the final depth to be adjusted using the size adjustment nut 82.

Clockwise of arc A42 is located arc A43. Arc A43 is typically 15° according to this embodiment. It is characterized by a radius R43 that decreases over its length. Arc A43 decreases in radius to gradually relieve forming pressure on the part and prevent formation of undesirable flat spots on the formed surface that might otherwise form if forming pressure were rapidly removed from the part. Clockwise of arc A43 is located the cutout 202. As noted above, after one revolution of the dies 30 and 31, the part is ejected from the size control ring 118 while adjacent each of the die surface cutouts 202. The cutouts 202 have adequate clearance according to this invention to allow a part shoulder, such as shoulder 152, to pass therethrough. While a set number of part revolutions are contemplated for the preforming and reforming processes according to this embodiment, there is no appreciable limit to the forming depth that can be obtained according to this invention. So long as a sufficient die circumference is provided to generate a desired number of work revolutions, the forming depth can be increased.

Figure 7B:
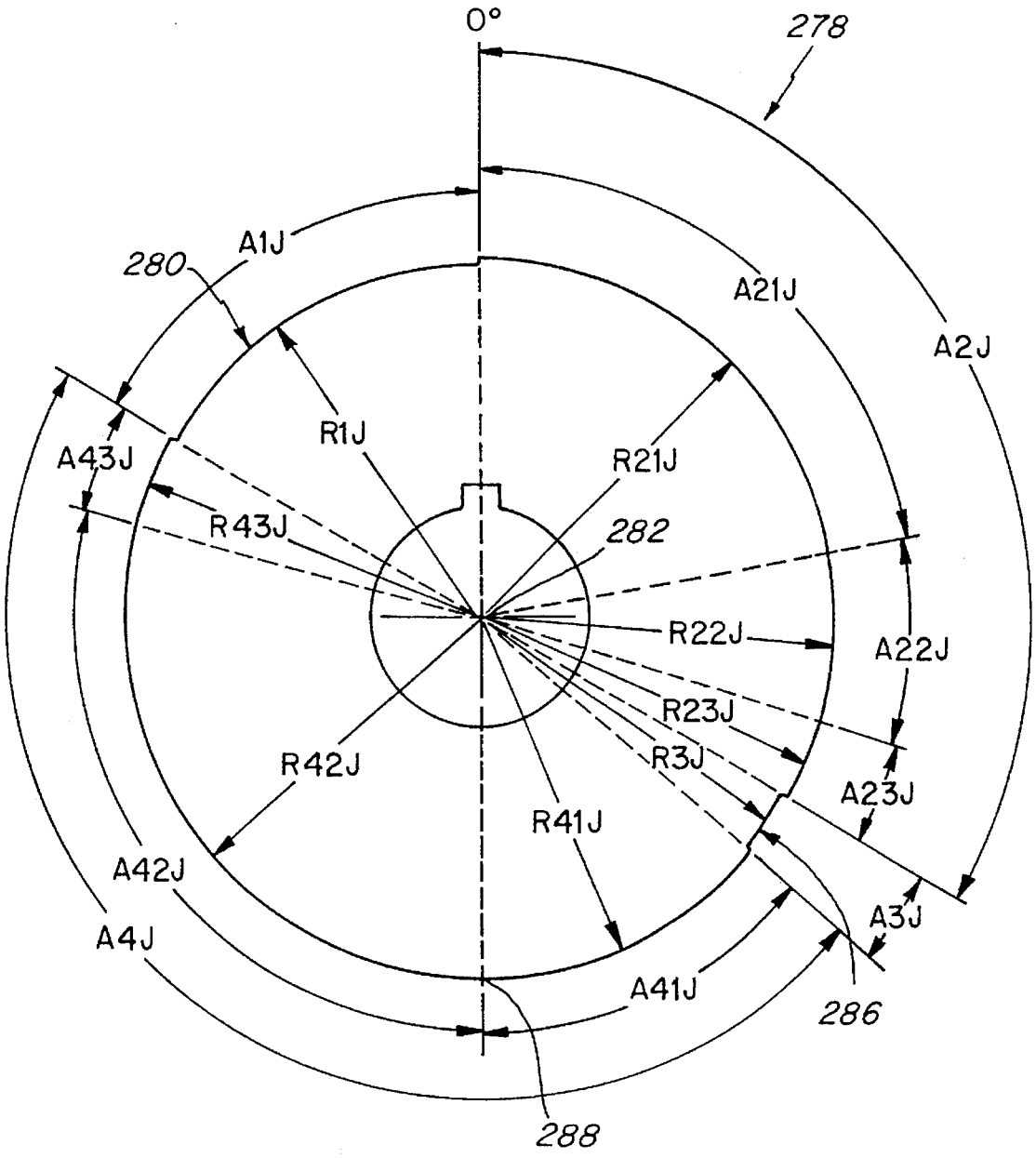
FIG. 7B is a more detailed schematic view of a die of FIG. 7 illustrating the circumferential locations of the various forming sections for a typical sleeve bearing journal surface forming embodiment.
Figure 7C:
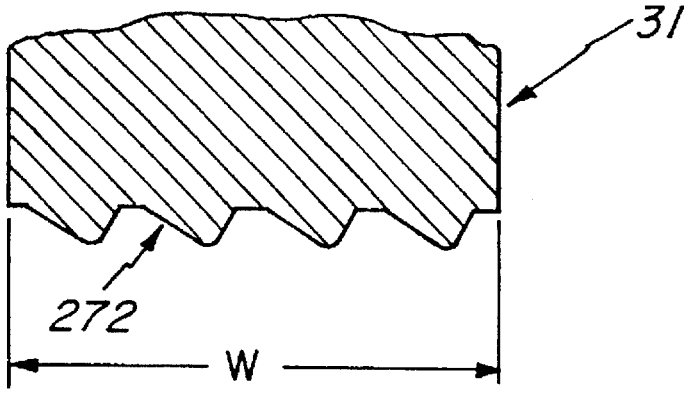
FIG. 7C is a typical surface contour for a press fit bearing surface forming die according to FIG. 7A.

FIG. 7C illustrates a reform profile 272 for the die 31 described in FIG. 7A at a point of maximum penetration. In this embodiment, the width W of the profile is approximately 0.375 inch.

Figure 10:
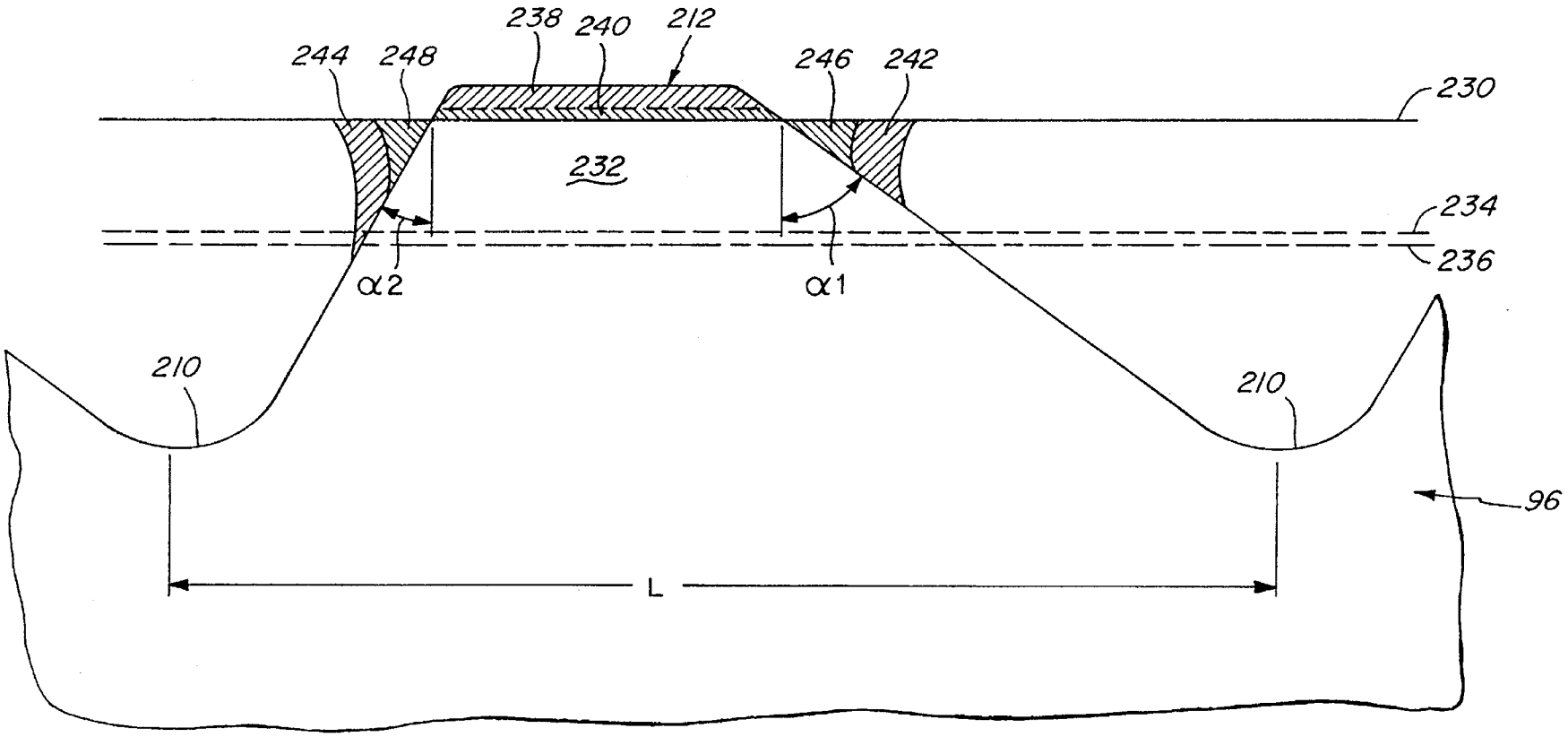
FIG. 10 is a somewhat schematic partial side view of a shaft press fit bearing surface showing minimum and maximum shaft blank size diameters according to this invention.

FIG. 10 illustrates a typical cross-section for a formed bearing surface for a part 96 formed according to this invention. Line 230 represents the desired finished diameter after reforming. The reformed crest 212 is pressed to this final diameter 230 by moving the material of the crest to each side of the raised surface 232. The unformed part blank surface according to this embodiment can fall within a given tolerance range between a maximum diameter 234 and a minimum diameter 236. In this embodiment, a tolerance of approximately 2/1000 inch between the minimum and maximum blank surface diameter is contemplated. A larger diameter blank surface will cause a larger diameter crest 212 to be formed. In this embodiment, the excess material 238 results from a larger blank diameter 234 while the lower amount of excess material 240 results from a smaller blank diameter 236. For a larger amount of blank material 238, the reforming process relocates the material to the locations 242 and 244 while a smaller amount of material is located to locations 246 and 248 along the sides of the raised surface 232. The minimum and maximum blank diameters should be maintained within predetermined limits, otherwise, the excess material 242, 244, 246 and 248 would form an undesirable lip upon reform with too much undercut. In this embodiment, the angles $\alpha 1$ and $\alpha 2$ define the two preform side edges are 50° and 30°, respectively. The distance between troughs 210 equals L, which is approximately 0.0910 inch according to this invention.

Figure 12:
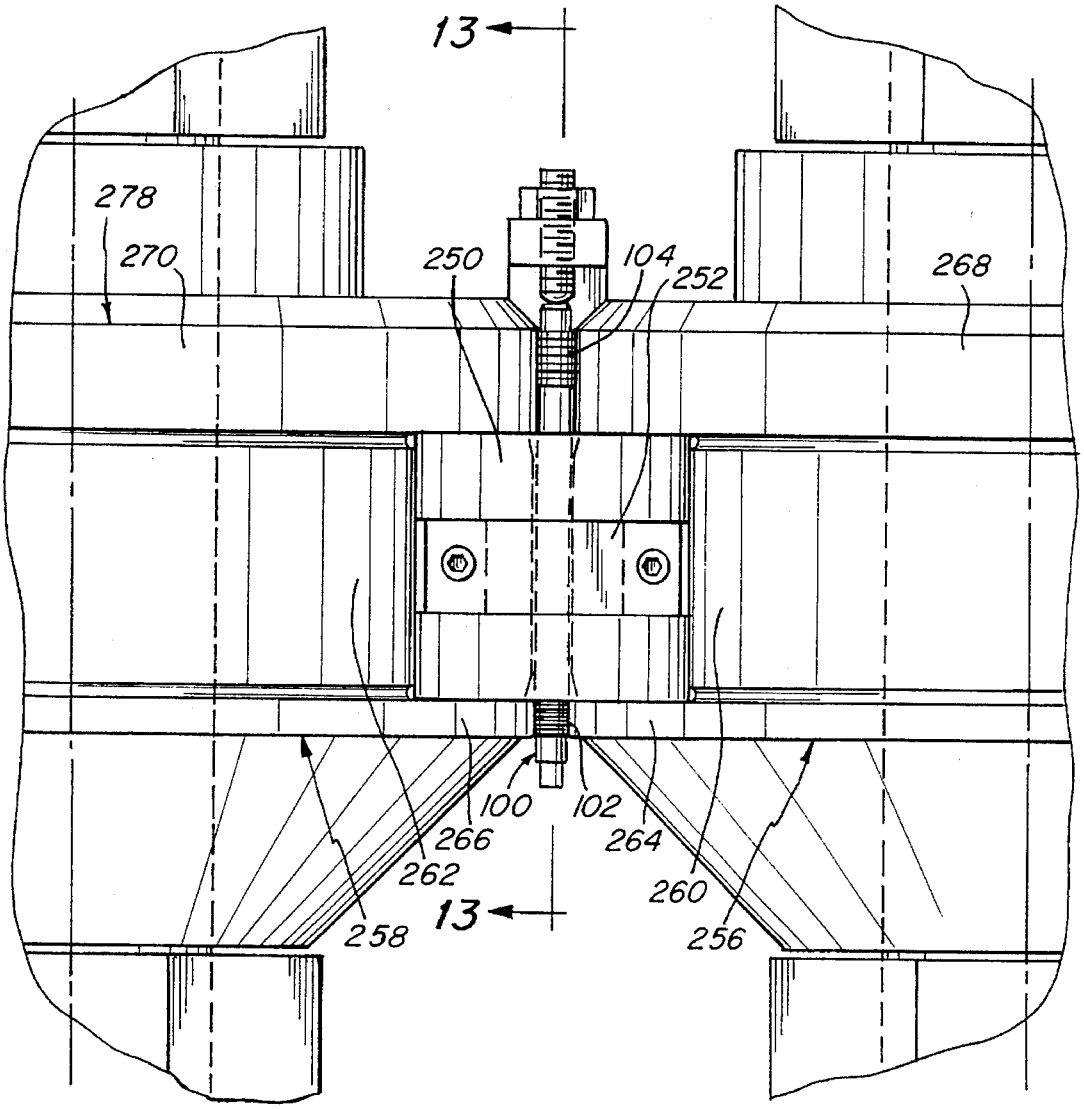
FIG. 12 is a partial plan view of an alternate embodiment of an apparatus for forming precision surfaces on shaft-like parts according to this invention including a pair of dies each having two axially spaced forming surfaces.
Figure 13:
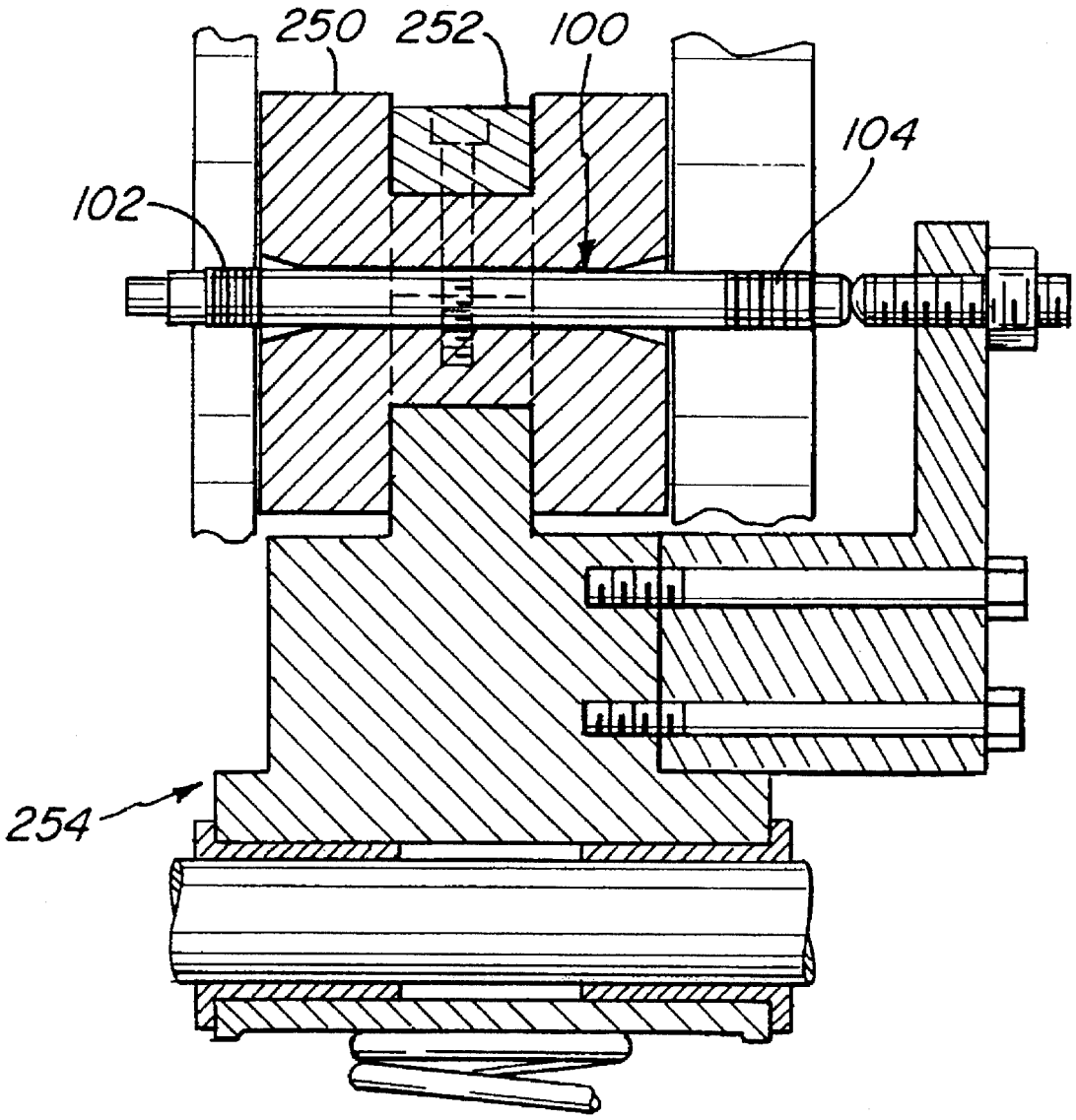
FIG. 13 is a partial cross-section taken along line 13—13 of FIG. 12.

With further reference to FIG. 11, the shaft 100 includes a pair of bearing surfaces including a press fit surface 102 and a sleeve bearing journal surface 104. FIGS. 12–13 illustrate an alternate embodiment in which both forms of surfaces are formed simultaneously. It is contemplated that either type of journal can be formed by the embodiment of FIG. 1. However, it is also contemplated that both surfaces can be formed simultaneously using a dual forming surface die arrangement. Such an arrangement is depicted in FIGS. 12–13. In general, the roll preforming and reforming (sizing) of two axially remote surfaces an a shaft-like part can be accomplished most effectively where the diameters of both the blank end finished surfaces for each axially remote area do not differ by more than approximately 25%. Beyond this difference, slippage tends to develop between the two dies and the workpiece. This slippage can cause surface distortions.

The shaft-like part 100 is positioned in a size control ring 250 according to this embodiment. The size control ring 250 is mounted in a bearing block 252 wherein the size control ring 250 is free to rotate relative to the block 252. The block 252 is mounted on a suspension platform 254 (FIG. 13) similar to that utilized in the embodiment of FIG. 1. The suspension platform allows a size control ring 250 to move radially in response to movement of the dies 256 and 258. For the purposes of this discussion, it can be assumed that the dies 256 and 258 include mountings that enable at least one of the dies to be moved toward the other of the dies under pressure using, for example, a size adjustment bar or screw such as screw 74 illustrated for the embodiment of FIG. 1. Each of the dies 256 and 258 includes a size control surface 260 and 262 that engages the surface of the size control ring 250. Hence, pressurable engagement of the size control surfaces 260 and 262 with the size control ring 250 causes a elastic deflection that serves to preload the system and substantially eliminates spring-back in the shaft-like part 100 as the bearing surfaces 102 and 104 are formed thereon. The bearing surfaces 102 and 104 are particularly formed using forming surfaces 264, 266, 268 and 270. It can be assumed that press fit bearing forming surfaces 264 and 266 are substantially similar to surfaces 110 and 112 described above with reference to the embodiment of FIG. 1.

The dies 256 and 258 have additional forming surfaces 268 and 270 that are more closely suited to the formation of a sleeve bearing journal surface such as surface 104. Like FIG. 7A, FIG. 7B details various forming sections along the circumference of the die 278. The sleeve journal being forming die 278 includes a cutout section 280, like that of dies 30 and 31. Typically, the cutout section 280 includes an arc length A1J of 60°. This cutout is aligned with a similar cutout on the front die surface 266. The radius R1J of the cutout taken from the axis of rotation 282 is 1/16 inch less than a radius needed to contact the presized surface of the blank shaft-like part 100. Clockwise of the cutout 280, is located the preform section having an arc length A2J of approximately 120°. The first section of arc length A2J is an increasing taper section defined by arc A21J of 80° and having a radius R21J. The pitch of R21J increases by as much as 9/1000 inch over the arc length A21J to a maximum forming depth that is maintained through the arc A22J (the "dwell" section) having a radius of R22J. Arc A22J is approximately 27° according to this embodiment.

Clockwise of arc A22J is located arc A23J that is approximately 15° according to this invention. The radius R23J decreases rapidly by several thousandths of an inch over arc A23J. Clockwise of arc A23J is located arc A3J, having radius R3J. This section comprises a cutout 286 wherein R3J is approximately 1/16 inch smaller than the end of arc A23J. Arc A3J is approximately 10°.

Clockwise of the cutout 286 is located the reform section which, according to this embodiment, is defined by arc A4J that spans 170° overall. The initial section of arc A4J is A41J, that is 50°. Radius R41J increases rapidly to point 288 wherein a maximum reform radius is attained. The maximum reform radius R42J is maintained through adjacent arc A42J which comprises the "dwell" section of the die reform portion A4J. Arc A42J spans 105° according to this embodiment.

Adjacent arc A42J is arc A43J, having rapidly decreasing radius R43J. Arc A43J spans 15° and is adjacent cutout 280.

It provides a gradual decrease in forming pressure to the part to prevent formation of flat spots thereon.

Figure 7D:
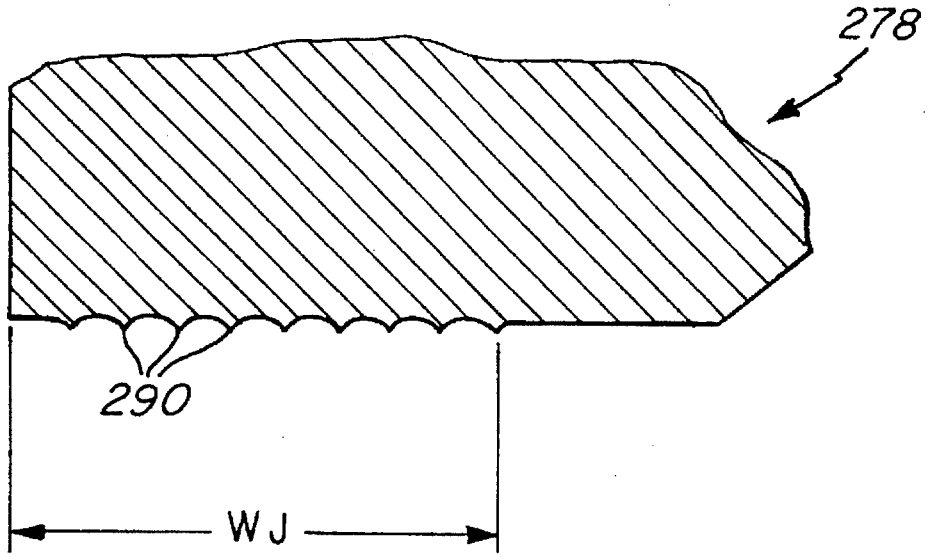
FIG. 7D is a typical surface contour for a sleeve bearing journal surface forming embodiment for the die of FIG. 7B.

One embodiment of a die journal bearing preform section is depicted in FIG. 7D. This section includes 9 crests 290 over width WJ of approximately 0.74 inch. To form both bearing surfaces on a part simultaneously according to FIGS. 12 and 13, pressure should be applied to enable accurate forming of both surfaces to a desired depth. Due to the substantial preloading of the surface by virtue of interaction between the size controlled surfaces 260 and 262, and the size control ring 250, both surfaces 102 and 104 can be formed accurately and repeatedly simultaneously. As illustrated in FIGS. 7A and 7B, the exact circumferential length of the preform and reform sections can vary for each of the press fit and journal die surfaces 264 and 266 or 268 and 270, respectively. However, preform and reform sections are located in the same order and the cutouts for each pair of dies should be aligned.

Figure 10A:
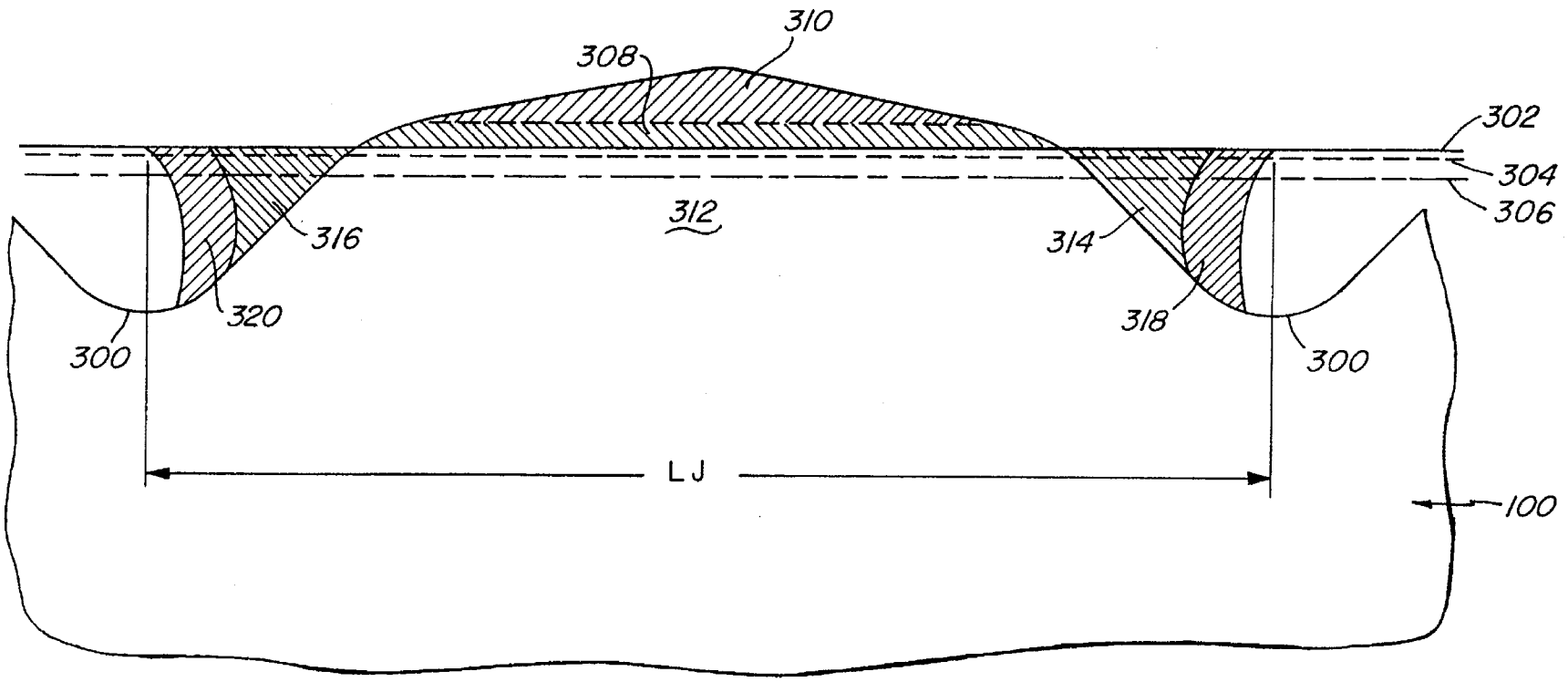
FIG. 10A is a somewhat schematic partial side view of a shaft sleeve bearing journal surface showing minimum and maximum shaft blank size diameters according to this invention.

With reference to FIG. 10A, a partial cross-section of a preformed and reformed journal bearing sleeve surface for the shaft-like part 100 is illustrated. In this embodiment, the distance LJ between troughs 300 is approximately 0.0820 inch. Line 302 represents the reformed diameter size which can vary by 0.0003 inch according to this embodiment. Line 304 represents the maximum blank diameter size, while line 306 represents the minimum blank diameter size. The blank diameter can vary by 3/1000 inch according to this embodiment. For a minimum blank diameter size, the preform peak includes excess material 308. Similarly, for a maximum blank diameter size, the preform peak includes additional excess material 310. Upon reforming, the minimum material is translated to the sides of the raised surface 312 to locations 314 and 316, while additional peak material 310 further increases the side material upon reforming to areas 318 and 320.

This invention contemplates that shaft-like parts can be preformed by another process or device prior to entry into the rolling machine 20 according to this invention. This machine provides enhanced tolerances for both preforming and reforming processes. However, so long as a sufficient diametral tolerance range is maintained during a separate preforming process, the shaft like part will be sized to high finished tolerance performing only reforming on the machine 20 according to this invention. Where preforming is to be performed separately to the shaft-like part, it can be accomplished by turning, grinding, extruding, rolling or other suitable methods.

Similarly, the reforming or sizing process as described herein need not be performed solely by means of die reform surfaces. FIG. 9A illustrates an alternate embodiment in which a fully enveloping cylindrical sizing die 328 is forced over the front of shaft-like part 330 in the direction illustrated by arrow 332. As the die is forced over the shaft, it forms a final press fit bearing surface 334 from the otherwise undulating preform surface 336, according to this embodiment. Such a process would involve location of a die adjacent to the front of the roll forming machine according to this invention. The die can be attached to the machine or provided separately in a subsequent forming step. The die can be passed onto and off of the front of shaft-like part 330 using a hydraulic press or similar biasing mechanism. Note, however, that when using this type of die for the final reforming step, the reforming operation has no size adjustability without first lapping or resizing the fully enveloping die.

Figure 14:
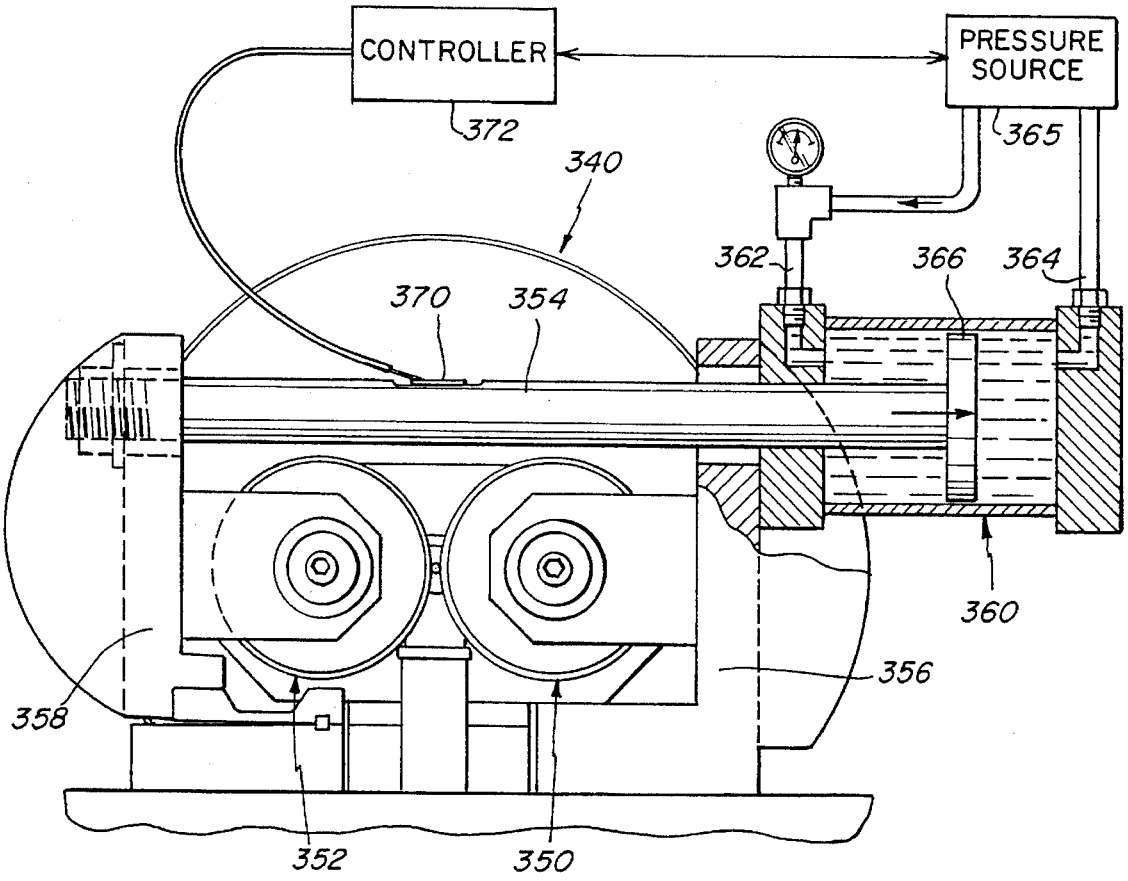
FIG. 14 is a somewhat schematic front elevation view of yet another alternate embodiment of an apparatus for forming precision surfaces on shaft-like parts according to this invention detailing a hydraulic size adjustment device.

Additionally, the compression of dies according to this invention need not be performed solely by means of a threaded draw bar 74 and adjusting nut 82. FIG. 14 illustrates a roll forming machine 340 substantially like that of the embodiment of FIG. 1. The dies 350 and 352 are biased toward each other by means of a size control draw bar 354 that is interconnected with each of the die bases 356 and 358, and is also interconnected with a hydraulic cylinder 360. Hydraulic cylinder receives hydraulic pressure via a pair of inlets 362 and 364 from a source 365 to apply pressure to the bar. By controlling the pressure applied to a piston 366 in the cylinder 360, a predetermined pressure to be applied to the dies 350 and 352. Automatic size adjustment could be provided by interconnecting the strain gauge 370 through a central processing unit with a hydraulic controller 372. In this manner, the controller 372 can monitor pressure exerted by the dies 350 and 352 and maintain it within a desired range. The hydraulic cylinder 360 also enables the use of dies having no circumferential cutouts or non-cylindrical surfaces, since the hydraulic cylinder can open and close the dies as each shaft-like part is processed. As a practical matter, this enables the use of dies capable of generating more part work revolutions. In fact, an indeterminate number of work revolutions can be applied to the forming process since the dies can be continuously closed by the hydraulic cylinder as the dies rotate through multiple revolutions.

The foregoing has been a detailed description of the preferred embodiments. Various modifications and additions can be made without departing from the spirit and scope of this invention. Accordingly, this description is meant to be taken only by way of example and not to otherwise limit the scope of the invention.

What is claimed is:

1. An apparatus for forming predetermined surface shapes on shaft-like parts comprising:

a pair of substantially cylindrical rotatable dies that each rotate on a respective axis, each of the dies including a preform surface defining an annular preform surface-forming shape over at least a portion of a circumference thereof, each of the dies further including a size control surface concentric with the respective axis;

a size control ring located between each of the size control surfaces, the size control ring rotating on an axis and constructed and arranged to support a shaft-like part therein at a location concentric with the axis thereof, the size control ring having an outer circumference; and a size adjustment mechanism constructed and arranged to apply force to each of the dies so that the dies forcibly engage and plastically deform with the shaft-like part and to apply force to each of the size control services so that the size control surfaces forcibly engage the size control ring, wherein each of the size control ring and the size control surfaces are arranged and sized so that the application of a plastically deforming force to the shaft-like part to form a predetermined surface shape therein occurs upon application of substantial elastic deformation to the size control ring.

2. Apparatus as set forth in claim 1 wherein the size adjustment mechanism comprises a screw having a size adjustment nut at one end thereof.

3. Apparatus as set forth in claim 2 further comprising a force sensor interconnected with the screw that measures a force applied by each of the size control surfaces to the size control ring.

4. Apparatus as set forth in claim 1 wherein each of the cylindrical dies further comprises a reform surface circumferentially adjacent the preform surface for forming a final shape on the shaft-like part.

5. Apparatus as set forth in claim 1 further comprising a fully enveloping cylindrical sizing die for providing a reform shape on the shaft-like part subsequent to formation of a preform shape on the shaft.

6. Apparatus as set forth in claim 5 wherein the die includes means for locating a die over an end of the shaft-like part when the part is mounted in the size control ring.

7. Apparatus as set forth in claim 5 wherein each of the dies are constructed and arranged to provide a preform and a reform shape to the shaft-like part in a single rotational revolution of each of the dies.

8. Apparatus as set forth in claim 1 wherein the size adjustment mechanism comprises means for adjusting pressurable engagement of the die surfaces with the shaft-like part, the means for adjusting including means for changing a contact pressure of the size control surfaces with the size control ring.

9. Apparatus as set forth in claim 1 wherein the size adjustment mechanism comprises a size control bar including a hydraulic cylinder for applying pressure to each of the dies.

10. Apparatus as set forth in claim 1 wherein the size control bar includes a stress sensor for reading contact pressure exerted by the dies against the size control ring.

11. Apparatus as set forth in claim 10 further comprising a controller that adjusts pressure of the dies against the size control ring in response to the stress sensor.

12. Apparatus as set forth in claim 1 wherein each die includes at least two axially remote preform surfaces, each of the axially remote surfaces including a respective preform surface engaging axially remote portions of the shaft-like part.

13. Apparatus as set forth in claim 1 wherein the size control ring comprises a section of a cone wherein the size control ring is axially movable to vary a depth of engagement of the die preform surfaces into the shaft-like part.

14. A method for forming predetermined surface shapes on shaft-like parts comprising the steps of:

providing a pair of substantially cylindrical forming surfaces, each of the surfaces including a preform surface that defines an annular preform surface-forming shape located over predetermined portion of a circumference of the forming surfaces, each of the forming surfaces further including a size control surface concentric with a respective rotational axis of the forming surfaces;

providing a size control ring that rotates on an axis and locating a shaft-like part concentric with the axis thereof; and applying force to the size control surfaces so that the size control surfaces engage the size control ring so as to cause substantial elastic deflection of the size control ring, the step applying force including locating the preform surfaces so that a predetermined penetration depth is pressed by the preform surfaces into the shaft-like part upon causing of the substantial elastic deflection of the size control ring whereby springback of the preform surfaces relative to the shaft-like part is minimized.

15. A method as set forth in claim 14 wherein each of the forming surfaces further comprise a reform surface circumferentially adjacent a respective preform surface and wherein the step of biasing includes locating the reform surfaces, subsequent to the step of locating the preform surfaces so that a finished surface is formed on the shaft-like part.

16. A method as set forth in claim 14 wherein the step of applying force includes applying a preload force to the size control ring of between approximately 25,000 and 50,000 pounds.

17. A method for forming predetermined surface shapes on shaft-like parts comprising the steps of:

providing a pair of substantially cylindrical forming surfaces, each of the surfaces including a reform surface that defines an annular preform surface-forming shape located over a predetermined portion of a circumference of the forming surfaces, each of the forming surfaces further including a size control surface concentric with a respective rotational axis of the forming surface;

providing a size control ring that rotates on an axis and locating a shaft-like part concentric with the axis thereof; and applying force to the size control surfaces so that the size control surfaces engage the size control ring so as to cause substantial elastic deflection of the size control ring, the step applying force including locating the reform surfaces so that a predetermined finish diameter surface is pressed by the reform surfaces into the shaft-like part upon causing of the substantial elastic deflection of the size control ring whereby springback of the preform surfaces relative to the shaft-like part is minimized.

18. A method as set forth in claim 17 further comprising preforming a predetermined surface shape at the predetermined point on the shaft-like part prior to the step of locating the reform surfaces.

19. A method as set forth in claim 18 wherein the step of preforming comprises provided a pair of cylindrical forming surfaces each including a preform surface circumferentially adjacent each respective reform surface, the step of applying force including locating the preform surfaces so that a predetermined penetration depth is pressed by the preform surfaces into the shaft-like part prior to the step of locating the reform surfaces.

20. A method as set forth in claim 18 wherein the step of preforming comprises at least one of grinding, turning and extruding a preformed shape after the predetermined point of the shaft-like part.

21. An apparatus for forming predetermined surface shapes on shaft-like parts comprising:

a pair of substantially cylindrical rotatable dies that each rotate on a respective axis, each of the dies including a reform surface defining an annular preform surface-forming shape over at least a portion of a circumference thereof, each of the dies further including a size control surface concentric with the respective axis;

a size control ring located between each of the size control surfaces, the size control ring rotating on an axis and constructed and arranged to support a shaft-like part therein at a location concentric with the axis thereof, the size control ring having an outer circumference; and a size adjustment mechanism constructed and arranged to apply force to each of the dies so that the dies forcibly engage and plastically deform with the shaft-like part and to apply force to each of the size control services so that the size control surfaces forcibly engage the size control ring, wherein each of the size control ring and the size control surfaces are arranged and sized so that the application of a plastically deforming force to the shaft-like part to form a predetermined surface shape therein occurs upon application of substantial elastic deformation to the size control ring.

22. Apparatus as set forth in claim 21 wherein the size adjustment mechanism comprises a screw having a size adjustment nut at one end thereof.

23. Apparatus as set forth in claim 21 wherein each of the dies are constructed and arranged to provide a preform and a reform shape to the shaft-like part in a single rotational revolution of each of the dies.

24. Apparatus as set forth in claim 21 wherein each of the cylindrical dies further comprises a preform surface circumferentially adjacent the reform surface for forming a preform shape on the shaft-like part, the preform shape being subsequently engaged by the reform surface of each of the dies.

25. Apparatus as set forth in claim 21 wherein the shaft includes a preform surface that is engaged by the reform surface, the preform surface comprising at least one crest and one trough, the reform surface relocating at least some material of the crest into the trough.

26. Apparatus as set forth in claim 21 wherein the size adjustment mechanism comprises means for adjusting pressurable engagement of the die surfaces with the shaft-like part, the means for adjusting including means for changing a contact pressure of the size control surfaces with the size control ring.

27. Apparatus as set forth in claim 21 wherein the size adjustment mechanism comprises a size control draw bar including a hydraulic cylinder for applying pressure to each of the dies.

28. Apparatus as set forth in claim 21 wherein the size control bar includes a stress sensor for reading contact pressure exerted by the dies against the size control ring.

29. Apparatus as set forth in claim 28 further comprising a controller that adjusts pressure of the dies against the size control ring in response to the stress sensor.

30. Apparatus as set forth in claim 21 wherein each die includes at least two axially remote preform surfaces, each of the axially remote surfaces including a respective preform surface engaging axially remote portions of the shaft-like part.

31. Apparatus as set forth in claim 21 wherein the size control ring comprises a section of a cone wherein the size control ring is axially movable to vary a depth of engagement of the die preform surfaces into the shaft-like part.

32. Apparatus as set forth in claim 21 wherein the size control ring further includes a sleeve concentric with the axis of the size control ring, the sleeve being rotatable freely relative to the size control ring and supporting the shaft-like part therein.

* * * * *